US007810909B2

(12) United States Patent
Shingyohuchi

(10) Patent No.: US 7,810,909 B2
(45) Date of Patent: Oct. 12, 2010

(54) LIQUID DROP JET APPARATUS AND IMAGE FORMING APPARATUS CAPABLE OF IMPROVING IMAGE QUALITY AND REDUCING COST

(75) Inventor: Mitsuru Shingyohuchi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 992 days.

(21) Appl. No.: 11/604,062

(22) Filed: Nov. 24, 2006

(65) Prior Publication Data

US 2007/0126802 A1 Jun. 7, 2007

(30) Foreign Application Priority Data

Nov. 25, 2005 (JP) ..... 2005-340329

(51) Int. Cl.
*B41J 2/04* (2006.01)

(52) U.S. Cl. ..... 347/54

(58) Field of Classification Search ..... 347/71, 347/68–70, 72; 400/124.14, 124.16; 310/311, 310/324

See application file for complete search history.

(56) References Cited

U.S. PATENT DOCUMENTS

| | | | |
|---|---|---|---|
| 5,293,182 A | 3/1994 | Sekiya et al. | |
| 5,389,962 A | 2/1995 | Sekiya et al. | |
| 5,420,618 A | 5/1995 | Sekiya et al. | |
| 5,754,202 A | 5/1998 | Sekiya et al. | |
| 6,729,716 B2 | 5/2004 | Eguchi et al. | |
| 6,811,238 B2 | 11/2004 | Shingyohuchi | |
| 2004/0207671 A1 | 10/2004 | Kusunoki et al. | |

FOREIGN PATENT DOCUMENTS

| | | | |
|---|---|---|---|
| JP | 2-289351 | | 11/1990 |
| JP | 6-143573 | | 5/1994 |
| JP | 10-100401 | | 4/1998 |
| JP | 2003-19794 | | 1/2003 |
| JP | 2003-266683 | * | 9/2003 |
| JP | 2004-90297 | | 3/2004 |
| JP | 2004-98310 | | 4/2004 |

* cited by examiner

*Primary Examiner*—K. Feggins
(74) *Attorney, Agent, or Firm*—Cooper & Dunham LLP

(57) ABSTRACT

A liquid drop jet apparatus is provided which includes a plurality of nozzles to jet out a liquid droplet, a liquid room corresponding to the nozzles, a liquid supply path to supply a liquid into the liquid room, a vibration board to apply a pressure to the liquid in the liquid room, and an electromechanical converter to vibrate the vibration board. The vibration board has a thin region corresponding to a wall of the liquid room and a thicker region thicker than the thin region. A longitudinal length of the thin region is longer than a longitudinal length of the liquid room, and the thicker region includes an end corresponding to a side of the liquid supply path.

15 Claims, 16 Drawing Sheets

LIQUID DROP JET APPARATUS AND IMAGE FORMING APPARATUS CAPABLE OF IMPROVING IMAGE QUALITY AND REDUCING COST

TECHNICAL FIELD

The present disclosure generally relates to a liquid drop jet apparatus and an image forming apparatus, and more particularly to an ink jet recording apparatus which jets out an ink droplet by vibrating a vibrating board using an electromechanical conversion element such as a piezoelectric element.

DISCUSSION OF THE BACKGROUND

A background ink jet apparatus used as an image forming apparatus such as a printer, a copying machine, and a facsimile, includes an ink jet head. An ink jet head includes a nozzle, a liquid room, and an actuator. The liquid room has other names such as a pressurized liquid room, a pressure room, a jet room, an ink channel, etc. The actuator generates a pressure in the liquid room to jet out an ink droplet through the nozzle. An ink-on-demand system is mainly adopted, which jets out an ink droplet only when a recording is required.

There are a few types of the ink-on-demand systems corresponding to types of actuators for jetting out an ink droplet. A piezo system is one that jets out an ink droplet by vibrating a thin vibrating board, which is a part of the wall of the liquid room, and changing a pressure in the liquid room, using a piezoelectric element. A bubble jet (registered trademark) system is another system that jets out an ink droplet with the pressure of an air bubble generated by applying heat through a heating element in a liquid room. An electrostatic system is another system that jets out an ink droplet by changing pressure and volume using a vibration of a vibrating board with an electrostatic force in an electric field between the vibrating board and an individual electrode arranged outside of the liquid room. The individual electrode faces the vibrating board which is a part of the wall of the liquid room.

In a system using an electromechanical conversion element such as a piezoelectric element as a pressure generation source, a vibrating board that has a convex part is commonly used. The convex part prevents a variation of volume or a speed of an ink droplet because it makes it easy to attach the piezoelectric element without applying too much adhesive or causing an unevenness of an excluded volume. As a shape of the convex part, an island shape, a stripe shape, etc. are known. A thick circumference of the convex part is also known.

It is necessary to limit displacement of the piezoelectric element only into a liquid room. If the piezoelectric element directly pushes up a channel unit that forms the liquid room, pressure in the liquid room does not increase, so that mutual interference or jetting stability may decrease due to transfer of vibration from the channel unit to the other channels. Therefore, the piezoelectric element is smaller than the liquid room in general. If the piezoelectric element is larger than the liquid room, a configuration in which a thin part (diaphragm part) reduces the direct push-up of the channel unit is commonly adopted.

FIG. 1 is a cross-sectional diagram illustrating an exemplary configuration of a liquid room of a background liquid drop jet apparatus. A piezoelectric element is used as an electromechanical conversion element which causes displacement in a d33 direction. This liquid drop jet apparatus includes an ink feed opening (not shown), an engraved frame

1 having a common liquid room 1-2, a fluid resistance part 2-1, a liquid room 2-2, a channel board 2 having a connecting opening 2-3 that connects a nozzle 3-1 formed in a nozzle board 3, a vibration board 6 having a thin diaphragm part 6-1, a thick convex part 6-2, and an ink inflow opening 6-3, a laminated piezoelectric element 5 having an external electrode 5-2 by which an FPC cable 7 is connected with an external electrode 5-1, and a base 4 that fixes the laminated piezoelectric element 5. In the background liquid drop jet apparatus, a whole piezoelectric element is set in the liquid room. The thick convex part 6-2 has a shape of a stripe. A longitudinal direction of a liquid room 2-2 is not separated by the thin diaphragm part 6-1. The whole piezoelectric element is set in the liquid room, so that the channel board is not pushed up.

Generally, high image quality is desired and perhaps needed, and therefore a small liquid droplet is needed, so that there is a tendency for liquid rooms to become smaller. In order to make a nozzle pitch fine, not only a width direction becomes short, but the length direction of the liquid room is short. This is for increasing a pressure resonance frequency of the liquid room to jet out a small ink droplet.

However, when the liquid room is shortened, the piezoelectric element as a pressure generating means cannot be shortened simply. FIG. 2 is a cross-sectional diagram of a piezoelectric element of the liquid drop jet apparatus of FIG. 1. As shown in FIG. 2, an active region in electric field does not simply vary. In order to connect with an external electrode, an inactive region where an internal electrode is not surely laminated exists. The inactive region reduces a displacement, so that a variable region according to an applied voltage is smaller than the active region. As shown in FIG. 2, if one side is fixed on the base, a restraint becomes strong, so that the variable region becomes smaller. Although the length of the inactive region is determined in accordance with restrictions in manufacturing, a piezoelectric element has a variation of about 50 micrometers. The length of the inactive region is needed to have about 150 micrometers. In short, even if the whole piezoelectric element is shortened, an inactive region is not made short. While an active region may be shortened, a restrained part by an inactive region may not be changed, so that a displacement may not be performed. That is, since conversion efficiency falls remarkably if a piezoelectric element is shortened, a piezoelectric element typically cannot be made small corresponding to a liquid room.

FIG. 3 is a diagram illustrating an exemplary configuration of the liquid room of FIG. 1. If the piezoelectric element is used in a d31 direction, it is easy to set the piezoelectric element in a liquid room, but the liquid room becomes smaller, and a lamination number must be reduced. However, if the lamination number is reduced, a power becomes small. Therefore, the piezoelectric element is longer than the liquid room as shown in FIG. 3, an escaping area by the diaphragm part 6-1 becomes large. However, a vibration board 6 becomes thin in this case, and this partial compliance becomes excessively large, so that a preferable jetting out characteristics is not realized.

There are a few problems. For example, the larger piezoelectric element displacement is needed due to a escaping pressure into the compliance, an inability to hold a high driving frequency caused by a long interval of jetting out due to a long resonance cycle of the pressure, an inability to make a small ink droplet, etc.

FIG. 4 is a cross-sectional diagram illustrating another exemplary configuration of a liquid room of a background liquid drop jet apparatus. As shown in FIG. 4, a convex part 6-2 and a laminated piezoelectric element 5 are joined with an adhesive 8 including a gap material. Thus, a patterned adhesive 8 reduces a displacement of the piezoelectric element to directly push up a channel unit by using a level difference by the gap material. However, when a nozzle pitch becomes fine like this and a structure becomes also fine, an application of the adhesive, which needs thickness, encounters difficult problems such as maintenance of a flow of the adhesive, the problem of a bridge, pattern accuracy of the adhesive, and maintenance of pressurization state in each junction part. In particular, it is very difficult when a long head is used, which has a large conjunction area. Therefore, although it is more desirable for adhesives to apply a necessary minimum quantity by a thin film transfer, they cannot make a level difference from this adhesion. In addition, a two layered vibration board (it will be three layers if adhesives are included) may reduce a problem of increasing a thin part area in a case of using a multi layered channel unit. But, using the multi layered channel unit may increase cost and reduce accuracy due to an increase of parts and processes.

SUMMARY

A novel liquid drop jet apparatus and a novel image forming apparatus are provided which can improve image quality and reduce cost. In one example, a novel liquid drop jet apparatus includes a plurality of nozzles to jet out a liquid droplet, a liquid room to apply a pressure to a liquid corresponding to the nozzles, a liquid supply path to supply the liquid into the liquid room, a vibration board to apply a pressure to the liquid in the liquid room, and an electromechanical converter to vibrate the vibration board. The vibration board has a thin region corresponding to the liquid room and a thicker region than the thin region. A longitudinal length of the thin region is longer than a longitudinal length of the liquid room and the thicker region includes a side of the liquid supply path.

A liquid drop jet apparatus, according to another exemplary embodiment, includes a nozzle to jet out a liquid droplet, a liquid room to provide a liquid to the nozzle, a liquid supply path to supply the liquid into the liquid room, a vibration board and an electromechanical converter. The vibration board applies pressure to the liquid in the liquid room, and has a thin diaphragm part corresponding to a wall of the liquid room and a thicker part thicker than the thin diaphragm part. A longitudinal length of the thin diaphragm part is longer than a longitudinal length of the liquid room, and the thicker part includes an end corresponding to a side of the liquid supply path. The electromechanical converter vibrates the vibration board.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
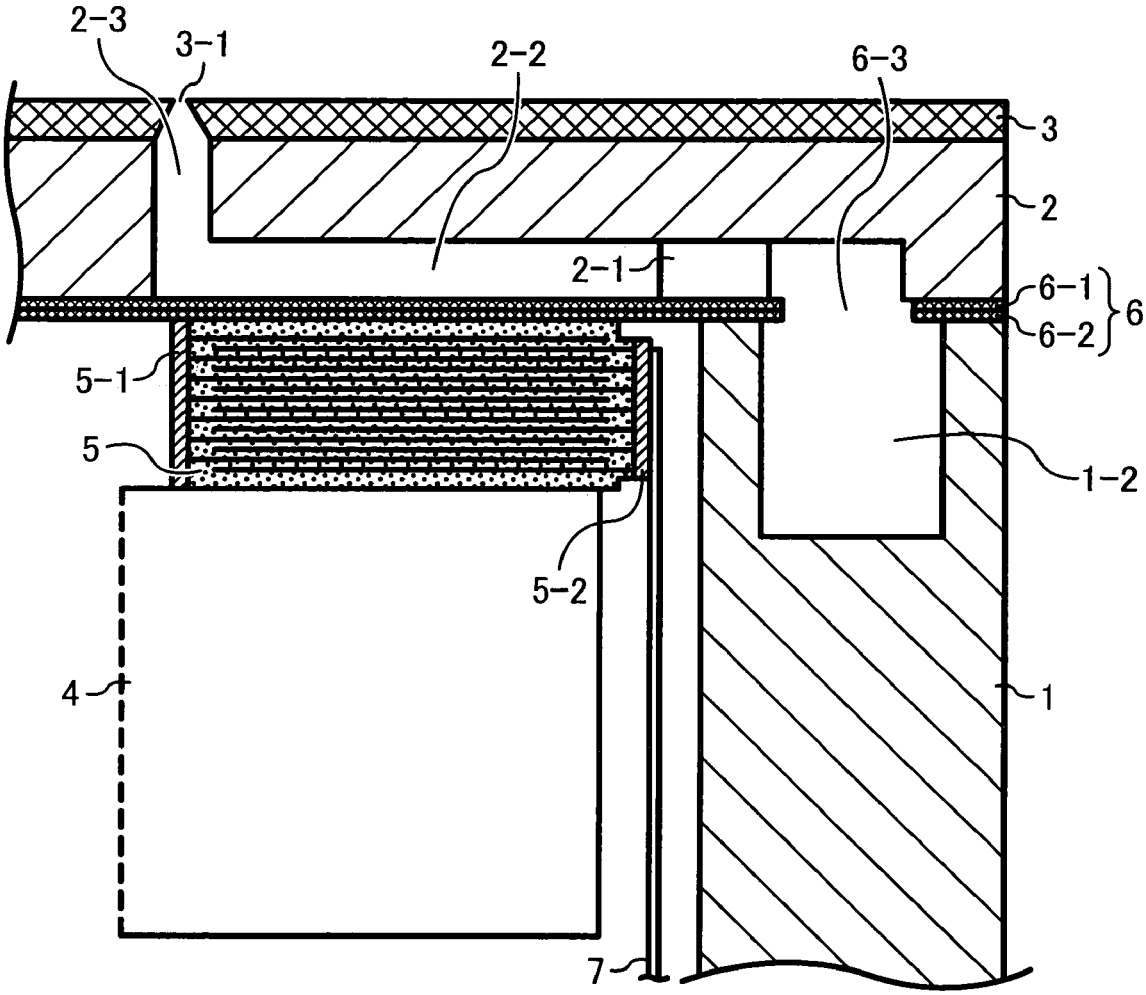
FIG. 1 PRIOR ART
FIG. 1 is a cross-sectional diagram illustrating an exemplary configuration of a liquid room of a background liquid drop jet apparatus.
Figure 2:
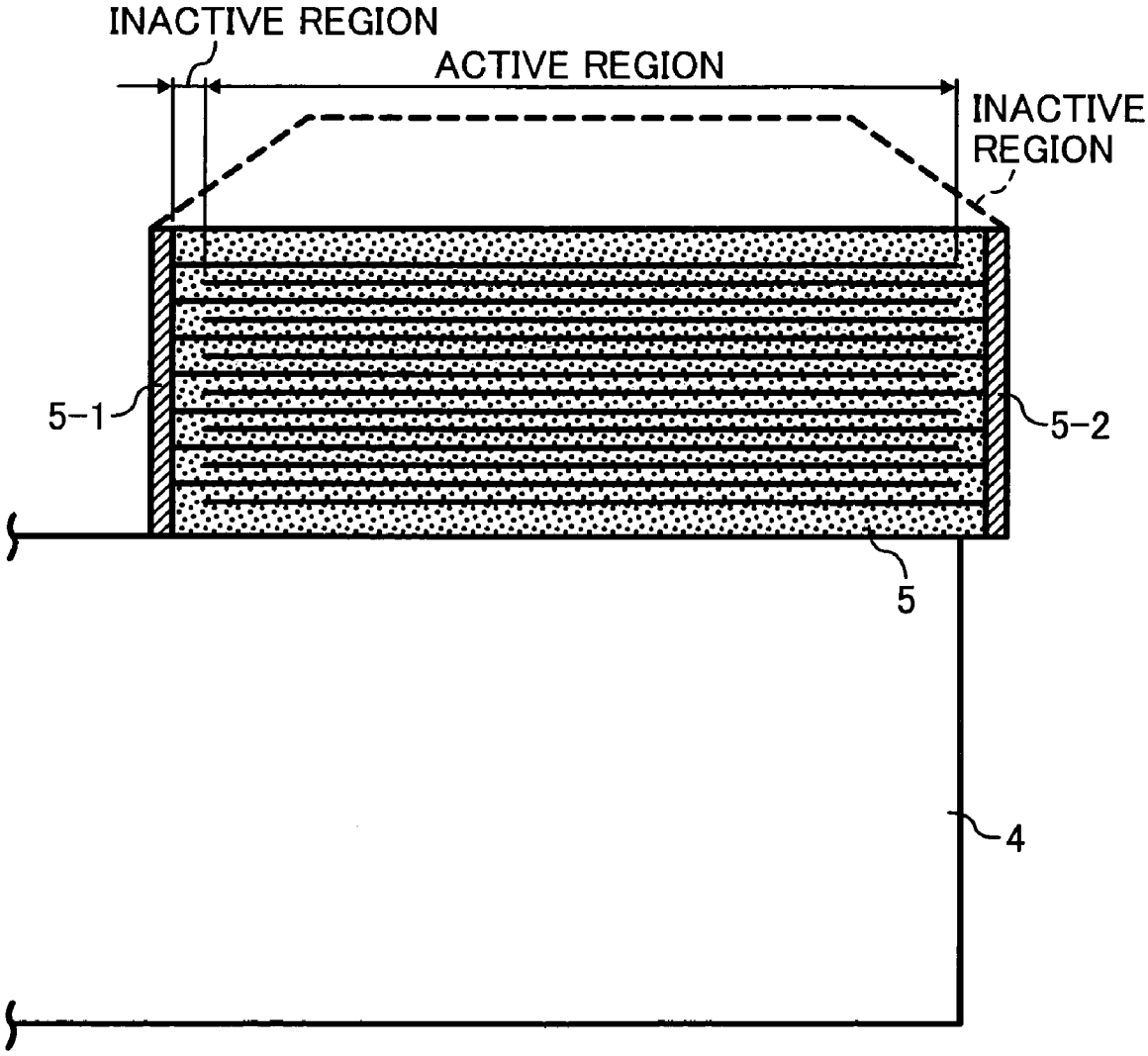
FIG. 2 PRIOR ART
FIG. 2 is a cross-sectional diagram of a piezoelectric element of the liquid drop jet apparatus of FIG. 1.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 5, an exemplary configuration of a liquid drop jet apparatus according to an exemplary embodiment of the present disclosure is explained.

Figure 5:
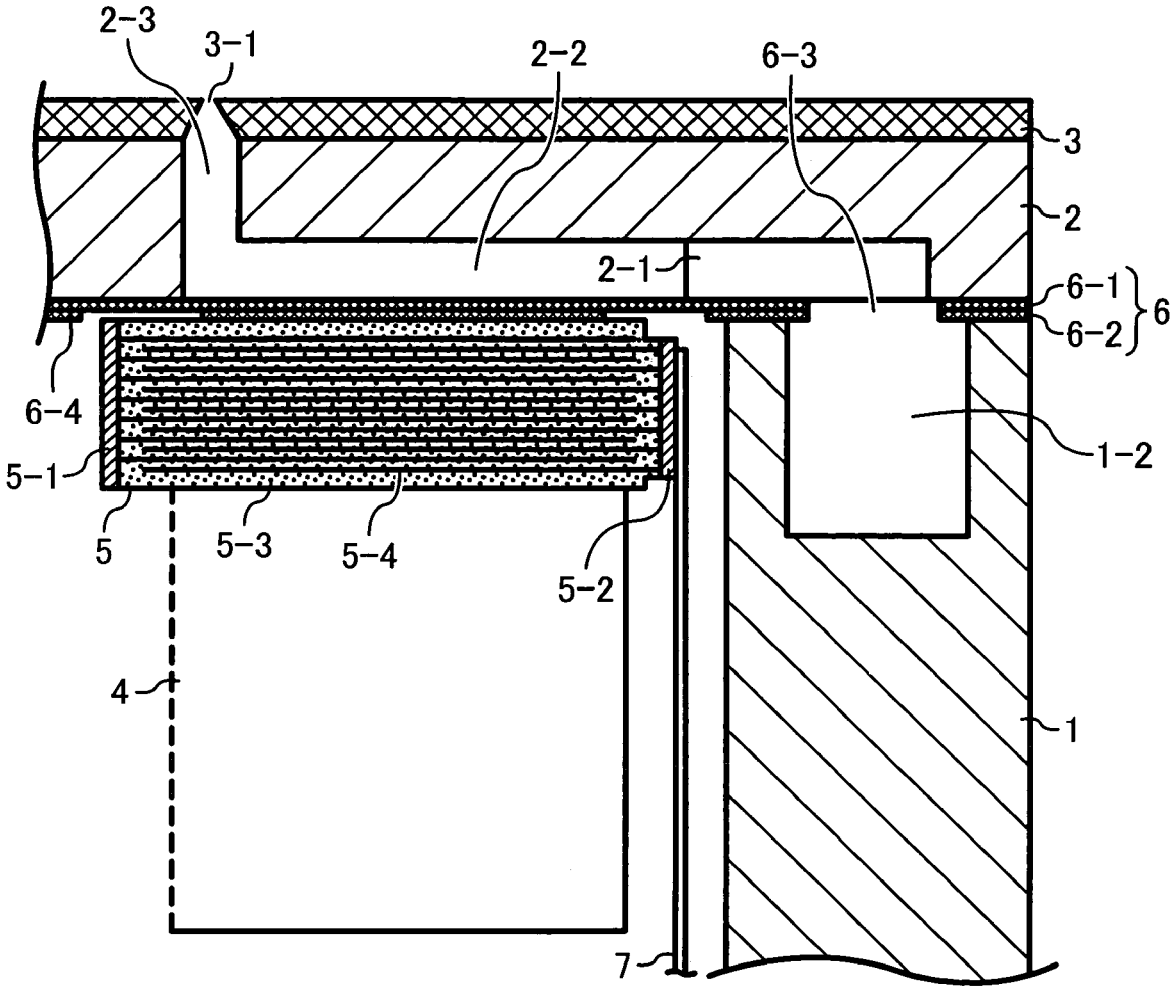
FIG. 5 is a cross-sectional diagram illustrating an exemplary configuration of a liquid room of a liquid drop jet apparatus according to an exemplary embodiment of the present disclosure.
Figure 6:
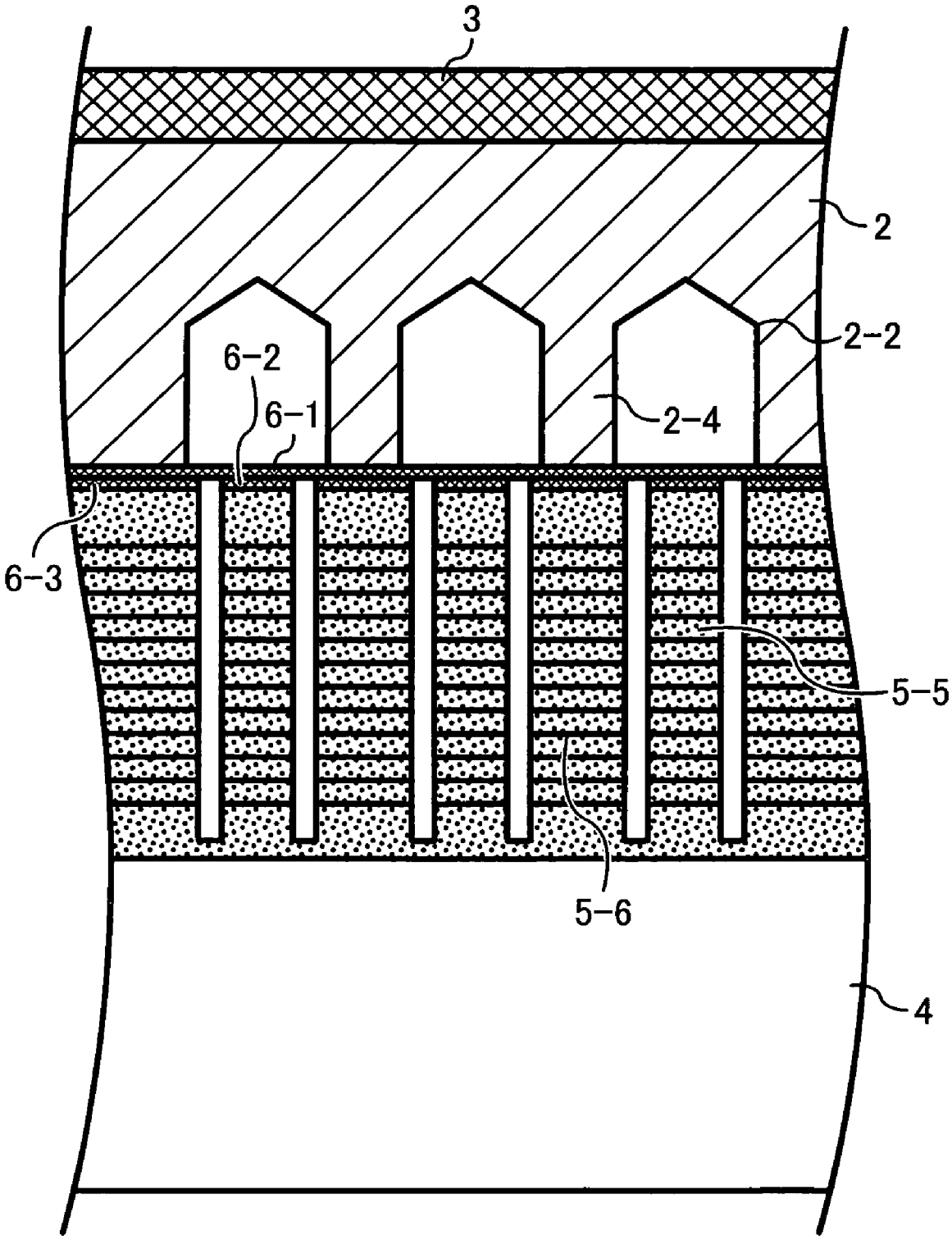
FIG. 6 is a cross-sectional diagram which is magnified in a channel's interval direction illustrating an exemplary configuration of an ink jet head of the liquid drop jet apparatus of FIG. 5.
Figure 7:
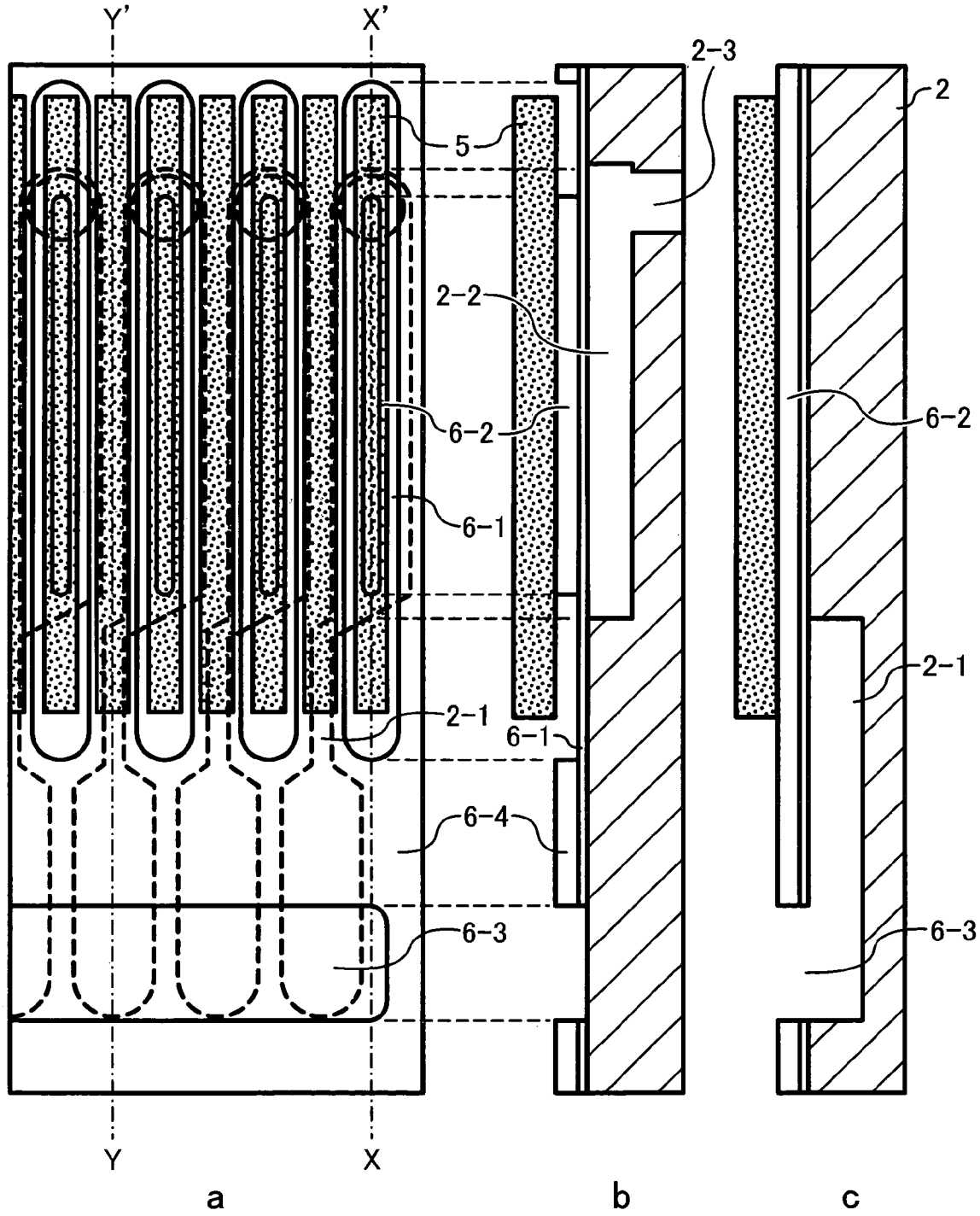
FIG. 7 is an illustration illustrating a layout of a vibration board configuration and a channel of the liquid drop jet apparatus of FIG. 5.

FIG. 5 is a cross-sectional diagram illustrating an exemplary configuration of a liquid room of a liquid drop jet apparatus according to an exemplary embodiment of the present disclosure. FIG. 6 is a cross-sectional diagram which is magnified in a channel interval direction illustrating an exemplary configuration of an ink jet head of the liquid drop jet apparatus of FIG. 5. FIG. 7 is an illustration illustrating a layout of a vibration board configuration and a channel of the liquid drop jet apparatus of FIG. 5. FIG. 7(*a*) illustrates an upper side diagram of the layout of the vibration board configuration and the channel of the liquid drop jet apparatus. FIG. 7(*b*) is a cross-sectional diagram of a line part X-X' of the liquid drop jet apparatus of FIG. 7(*a*). FIG. 7(*c*) is a cross-sectional diagram of a line part Y-Y' of the liquid drop jet apparatus of FIG. 7(*a*). In FIG. 5, FIG. 6, and FIG. 7, the same referential label as used in FIG. 1 refers to the same constituent element.

As shown in FIG. 5 and FIG. 6, this liquid drop jet apparatus includes an ink feed opening (not shown), an engraved frame 1 having a common liquid room 1-2, a fluid resistance part 2-1, a liquid room 2-2, a channel board 2 having a connecting opening 2-3 that connects a nozzle 3-1 formed in a nozzle board 3, a vibration board 6 having a thin diaphragm part 6-1, a thick convex part 6-2, an ink inflow opening 6-3, and a surrounding frame 6-4, a laminated piezoelectric element 5 having an external electrode 5-2 by which an FPC cable 7 is connected with an external electrode 5-1, and a base 4 that fixes the laminated piezoelectric element 5. The base 4 consists of a titanic acid barium system ceramics, has two sequences of laminated piezoelectric elements 5, and they are joined. In addition, insulating boards such as alumina and forsterite may be used as the base 4.

The laminated piezoelectric element 5 includes a piezoelectric layer 5-3 having a thickness of 10 to 50 micrometers as one piezoelectric zirconate titanate (PZT) layer, and an internal electrode layer 5-4 having a thickness of 1 to 10 micrometers as one Silver Palladium (AgPd) layer, which are mutually piled up. The internal electrode layer 5-4 is connected to the external electrodes 5-1 and 5-2 at both ends. As shown in FIG. 6, the laminated piezoelectric element 5 is divided by dicing processing of a half cut on a pectination, and is used for every cut as a drive part 5-5 and a support part 5-6 (non-driving part). This structure is called a large pitch structure. Since the channel unit is supported by the support part 5-6, it is very effective in preventing raising the channel board 2 and suppressing the so-called mutual interference due to a pressure increase of the liquid room 2-2.

An outside of the external electrode 5-2 is divided by dicing processing of a half cut, so that it limits length and the outside of the external electrode 5-2 becomes a plurality of individual electrodes. The external electrode 5-1 becomes a common electrode because it is not divided by dicing. A solder junction of the FPC cable 7 is carried out at the individual electrode of a drive part. The common electrode is joined to a Gnd electrode of the FPC cable 7 providing an electrode layer at the end of the laminated piezoelectric element. A driver IC which is not illustrated is mounted in the FPC cable 7, and controls a drive voltage to the drive part 5-5. An active region is a region in electric field overlapped by the internal electrode layer 5-4. An inactive region is a region without electric field near the external electrodes 5-1 and 5-2.

In the example, the liquid room has a length of 200 micrometers in a one side of the inactive region, 1200 micrometers in the active region, and 1600 micrometers in the laminated piezoelectric element. Both ends of the laminated piezoelectric element 5 is fixed in displacement due to a fixation to the base 4 and the inactive region. Since a mechanical property is the same, when the active region has a displacement and the inactive region restrains, the length of the active region where displacement is restrained is mostly in agreement with the length of the inactive region. An experimental result is 800 micrometers (=1200−200−200) in a center displacement, which is larger than 80% of a maximum displacement.

The vibration board 6 has a thin diaphragm part 6-1 having a laminated piezoelectric element 5 as a drive part 5-5, an island shaped convex part 6-2 joined to the thin diaphragm part 6-1, an ink inflow opening 6-3 in piles two layers of nickel plating films by electroforming, and a surrounding frame 6-4 including a beam that joins a support part 5-6. The liquid room has a length of 800 micrometers in a longitudinal direction, and a width of 139 micrometers. The width of a channel partition is about 30 micrometers in a bonded surface with the vibration board 6 (since a liquid room pitch is 150 dpi). As for the upper part of the liquid room 2-2, the section is a pentagon for the sake of the convenience in press processing. A channel board 2 has a thickness of 100 micrometers. The liquid room 2-2 has a depth of 50 micrometers.

A nozzle board 3 is formed by nickel plating film as metal material by electroforming, having many nozzles 3-1 which are fine discharge mouths for making an ink droplet to jet out. An internal form (inner side form) of this nozzle 3-1 has a horn shape (a pillar form or a trapezoid shape may be also possible). The path of this nozzle 3-1 has about 20-35 micrometers diameter at the side of an ink droplet exit. This example has a 24 micrometers diameter at the side of the ink droplet exit and a 150 dpi nozzle pitch.

The ink jetting out side (nozzle surface side) of this nozzle board 3 has a water-repellent surface layer 3-2 which is not illustrated. A PTFE-nickel eutectoid plating, a fluoro-resin electrodeposition coating, a fluoro-resin vapor deposition coating, and baking after a solvent application of a silicone or a fluoro-resin coating and providing a water-repellent surface according to ink physical properties causes an ink droplet shape and a jetting out characteristics to be stabilized, so that a high quality image is obtained.

An ink feeding opening and an engraved frame 1 having a common liquid room 1-2 are made by an injection moulding of an epoxy system resin. A polyphenylene sulfide may be used as the resin material.

A displacement of the lamination direction occurs in the drive part 5-5 by applying a drive waveform (pulse voltage of 10-50V) to the drive part 5-5 according to a record signal. The liquid room 2-2 is pressurized through the vibration board 3, and an ink droplet is jetted out from the nozzle 3-1.

After the end of the ink droplet discharge, the ink pressure in the liquid room 2-2 decreases, and a negative pressure occurs in the liquid room 2-2 by the electric discharge process of a drive pulse and an inertia of a flow of ink, and an ink feeding process starts. At this time, an ink from the ink tank flows into the common liquid room 1-2, and the ink passes along a fluid resistance part 2-1 through an ink inflow opening 6-3 from the common liquid room 1-2, and fills up in the liquid room 2-2. While the fluid resistance part 2-1 has an effect in attenuation of the residual pressure vibration after jetting out, it resists a maximum filling (refill) by surface tension. By choosing the fluid resistance part suitably, an attenuation of the residual pressure and a refill time are maintained to have a balance, and time (drive cycle) until it shifts to a next ink droplet jetting out operation may be shortened.

Figure 3:
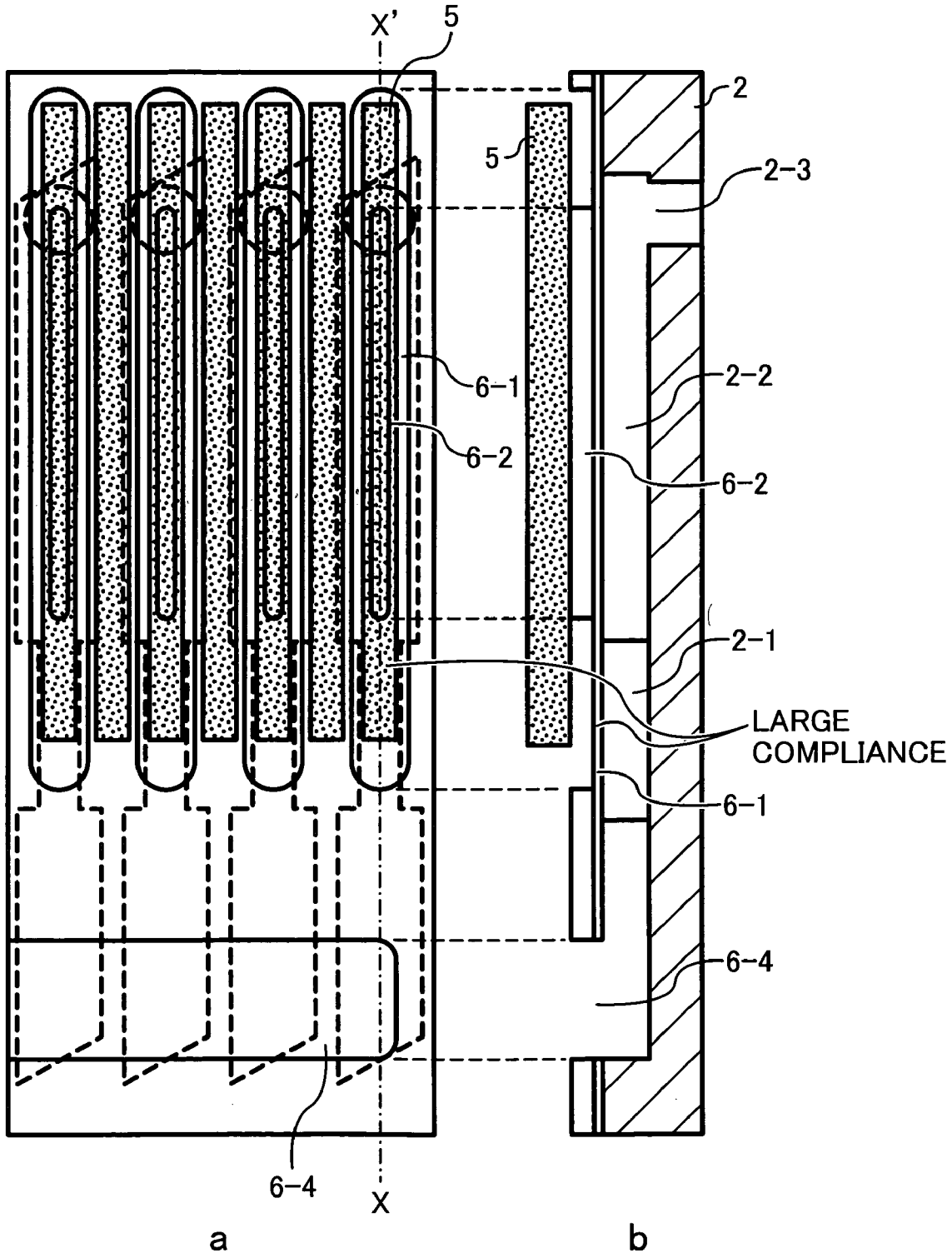
FIG. 3 PRIOR ART
FIG. 3 is a diagram illustrating an exemplary configuration of the liquid room of FIG. 1.
Figure 4:
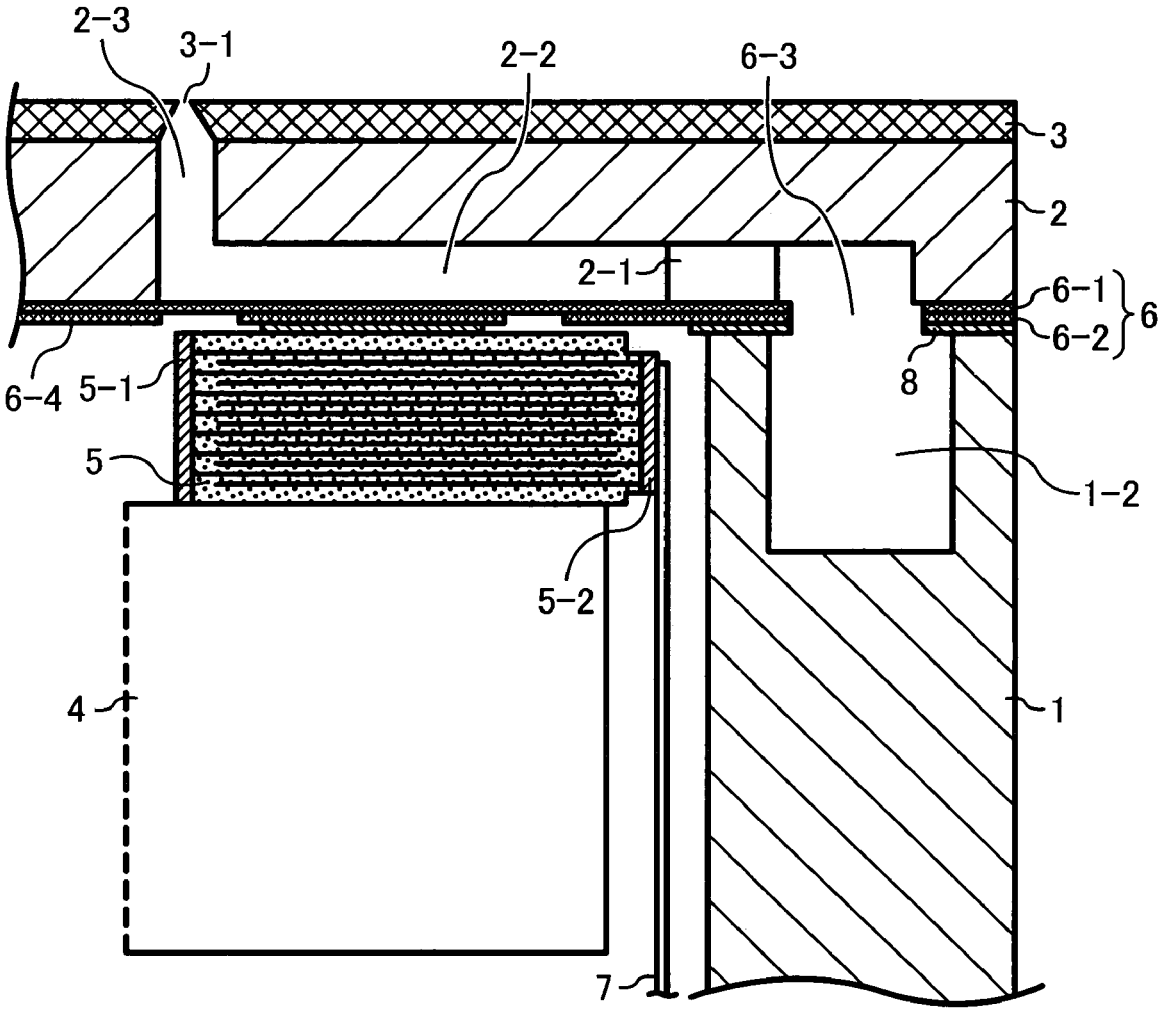
FIG. 4 PRIOR ART
FIG. 4 is a cross-sectional diagram illustrating another exemplary configuration of a liquid room of a background liquid drop jet apparatus.

In the fluid resistance part 2-1 as shown in FIG. 7(*a*), an ink supply path including the fluid resistance part 2-1 is arranged over a surrounding frame 6-4 of the vibration board 6 by bending from a longitudinal direction of the liquid room 2-2. For avoiding an over displacement of the laminated piezoelectric element 5 from the liquid room 2-2 to transfer to a channel unit (a vibration board, a channel board, and a nozzle board), the vibration board 6 has a thin diaphragm part 6-1, which is arranged over a support part 5-6, an area corresponding to the thin diaphragm part 6-1 is small. Thus, like a background example shown in FIG. 3, a large compliance is made in the fluid resistance part 2-1, and a pressure efficiency is not lowered. Moreover, a pressure resonance frequency may also be designed to a high value, and its drive frequency improves. Furthermore, it is advantageous to jet out a small droplet by applying a pressure resonance frequency that is high.

In the example, the laminated piezoelectric element 5 is used, which has a displacement in a d33 direction. The direction is not limited to the d33. When using a d31 direction or using actuators other than a piezoelectric element, a larger actuator than the liquid room 2-2 is effectively used. However, when using a piezoelectric element 5 in a d33 direction, use of an excluded volume effectively from existence of an inactive region and an escape area of the thin diaphragm part 6-1 as a thin part of the vibration board are traded off, and this exemplary embodiment is especially effective. On the other hand, if the piezoelectric element 5 of d33 direction is used, since the direction is the thickness direction, so that it is possible to assemble a head in a process of laminating the base 4, the piezoelectric element 5, the vibration board 6, the channel board 2, and the nozzle board 3. Since it is not a three-dimensional assembly, it is advantageous in respect of assembly accuracy, yield, etc. Although this exemplary embodiment does not specify the physical relationship of the convex part 6-2 of the laminated piezoelectric element 5 and the vibration board 6, for using effectively the excluded volume of the laminated piezoelectric element 5, it is desirable to the convex part 6-2 of the vinration board 6 to input in the active region of the laminated piezoelectric element 5 and to join together. A displacement of the inactive region is varied with the active region, a displacement is small and it is not possible to take excluded volume. Furthermore, as for the convex part 6-2 of the vibartion board 6, it may be desirable for this exemplary embodiment to be combined only with the portion which takes a sufficient displacement of the laminated piezoelectric element 5. Therefore, it is preferable to lengthen the active region more than twice of the excessive inactive region from the convex part 6-2, and join together at a almost center.

Since the inactive region of the direction of the liquid room works as a binding force, the end displacement of the active region is restrained as almost the same length as the inactive region. In order to give sufficient displacement for the whole convex part 6-2, the above relations are required for the length of the active region. An area of the thin diaphragm part 6-1 is large for the purpose of the escape in a connecting side to the laminated piezoelectric element 5. Since the supply path side is connected when arranging two sequences of the laminated piezoelectric elements 5 (when shifting and carrying out alternate arrangement of the drive part 5-5 of two sequences with the large pitch structure), an area of a thin part of an ink supply path side becomes large. Unless the ink supply path of the example is bended so that it may pass through a thick part, a pressure is hard to rise due to a large compliance with a large area. That is, the subject matter of this disclosure is more effective with the structure which has an electric connection in the supply path side. A use of this example makes it possible to arrange two sequences and to increase a flexibility of a layout.

Figure 8A:
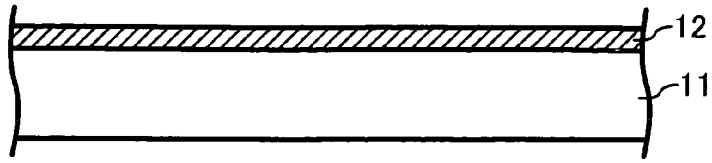
FIG. 8A is a cross-sectional diagram of a vibration board illustrating a process of electroforming of the liquid drop jet apparatus of FIG. 5.
Figure 8B:
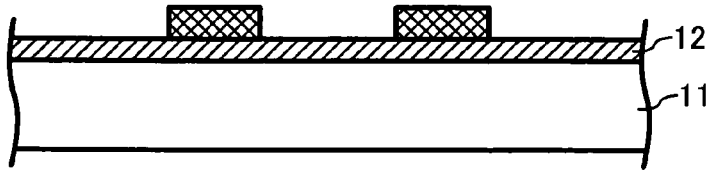
FIG. 8B is a cross-sectional diagram of a vibration board illustrating a process of electroforming of the liquid drop jet apparatus of FIG. 5.
Figure 8C:
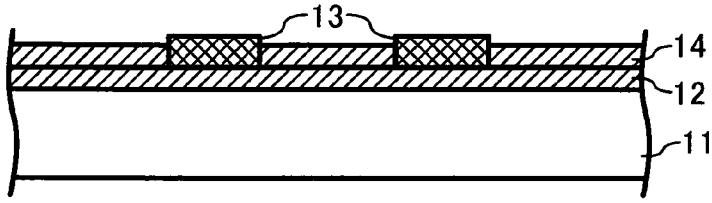
FIG. 8C is a cross-sectional diagram of a vibration board illustrating a process of electroforming of the liquid drop jet apparatus of FIG. 5.
Figure 8D:
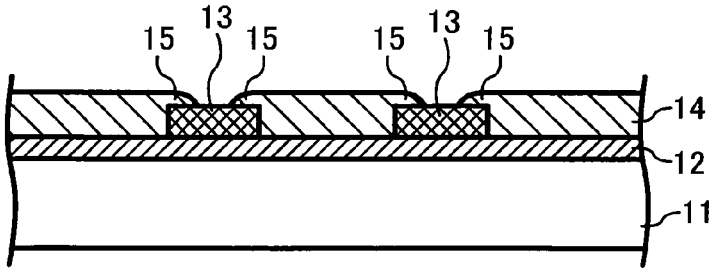
FIG. 8D is a cross-sectional diagram of a vibration board illustrating a process of electroforming of the liquid drop jet apparatus of FIG. 5.
Figure 8E:
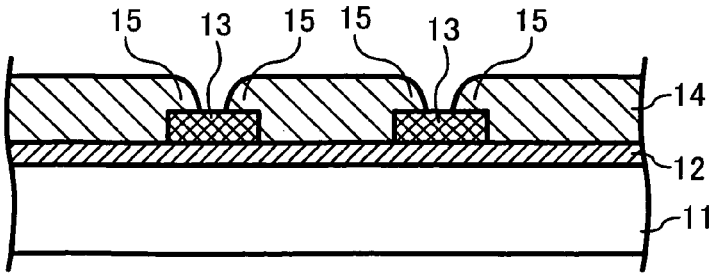
FIG. 8E is a cross-sectional diagram of a vibration board illustrating a process of electroforming of the liquid drop jet apparatus of FIG. 5.
Figure 8F:
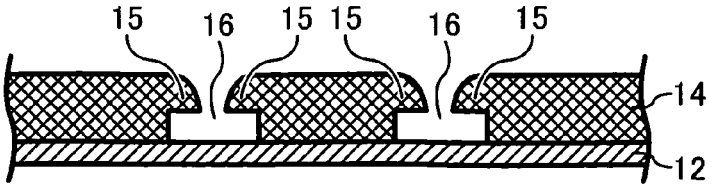
FIG. 8F is a cross-sectional diagram of a vibration board illustrating a process of electroforming of the liquid drop jet apparatus of FIG. 5.

FIG. 8A is a cross-sectional diagram of a vibration board illustrating a process of electroforming of the liquid drop jet apparatus of FIG. 5. FIG. 8B is a cross-sectional diagram of a vibration board illustrating a process of electroforming of the liquid drop jet apparatus of FIG. 5. FIG. 8C is a cross-sectional diagram of a vibration board illustrating a process of electroforming of the liquid drop jet apparatus of FIG. 5. FIG. 8D is a cross-sectional diagram of a vibration board illustrating a process of electroforming of the liquid drop jet apparatus of FIG. 5. FIG. 8E is a cross-sectional diagram of a vibration board illustrating a process of electroforming of the liquid drop jet apparatus of FIG. 5. FIG. 8F is a cross-sectional diagram of a vibration board illustrating a process of electroforming of the liquid drop jet apparatus of FIG. 5. As shown in FIG. 8A, a first layer 12, which forms a thin diaphragm part 6-1, is formed on an electroforming support board 11. As shown in FIG. 8B, a resist pattern 13 as a window corresponding to a convex part 6-2 is formed by such as a nickel electroforming. As shown in FIG. 8C, a nickel layer is formed on the first layer 12 by a separation. As shown in FIG. 8D, the nickel layer is formed until it protrudes from the window, an overhang part 15 arises in the direction of the surface of the pattern 13 according to an edge effect. As shown in FIG. 8E, after elongating the nickel layer further in the thickness direction and the direction of a plane, the electroforming is stopped and the pattern 13 is removed. As shown in FIG. 8F, the vibration board equipped with a cross-sectional rivet type island-like thick part 16 surrounded by a concave part 14 is obtained. In the example, the thin diaphragm part 6-1 has a thickness of 3 micrometers, a circumference of the convex part 6-2 has a width of 35 micrometers as one side. The length of the direction of the liquid room of the island-like convex part 6-2 is set to 720 micrometers, and the thickness is set to 12 micrometers. Since the thick surrounding frame part 6-4 is made simultaneously with the island-like convex part 6-1, its thickness is 12 micrometers. Although the length of the laminated piezoelectric element 5 is 1600 micrometers, the length of the diaphragm part 6-1 in a longitudinal direction of the liquid room 2-2 is set to 1900 micrometers. In consideration of a part tolerance, a displacement tolerance, etc., a length of 540 micrometers is applied at the nozzle side and the portion of only the thin diaphragm part 6-1 of 640-micrometer for escaping the FPC cable 7 and its terminal area is applied at the common liquid room 1-2 side. Combinations of the frame part 6-4 and the frame 1, the convex part 6-2 of the vibration board 6 and the drive part 5-5 of the laminated piezoelectric element 5, and the frame part 6-4 of the vibration board 6 and the support part 5-6 of the laminated piezoelectric element are pasted up, which is not illustrated. The channel board 2 uses a thin board SMS304 to make patterns of the fluid resistance part 2-1 and the liquid room 2-2 by pressing process, and a penetration openings are provided by pressing process at the positions of the connecting opening 2-3 and the nozzle 3-1. The other portion serves as the channel partition 2-4 of the liquid room 2-2. The channel board 2 is made of a material such as 42 alloys or another SMS material. A liquefaction-proof thin film which consists of organic resin films such as a nitriding titanium film or polyimide, is made on the touching side to the ink of the channel board 2. This liquefaction-proof thin film enables a channel board material hard to dissolute into the ink and an stay of bubble decreases, so that a stable ink droplet jetting is obtained.

In the example, the liquid room 2-2 has a length of 800 micrometers in a longitudinal direction and a width of 139 micrometers. The width of a channel partition is about 30 micrometers in a bonded surface with the vibration board 6 (since a liquid room pitch is 150 dpi). As for the upper part of the liquid room 2-2, the section is a pentagon for the sake of the convenience in press processing. A channel board 2 has a thickness of 100 micrometers. The liquid room 2-2 has a depth of 50 micrometers.

A nozzle board 3 is formed by nickel plating film as metal material by electroforming, having many nozzles 3-1 which are fine discharge mouths for making an ink droplet to jet out. An internal form (inner side form) of this nozzle 3-1 has a horn shape (a pillar form or a trapezoid shape may be also possible). The path of this nozzle 3-1 has about 20-35 micrometers diameter at the side of an ink droplet exit. This example has a 24 micrometers diameter at the side of the ink droplet exit and a 150 dpi nozzle pitch.

The ink jetting out side (nozzle surface side) of this nozzle board 3 has a water-repellent surface layer which is not illustrated. A PTFE-nickel eutectoid plating, a fluoro-resin electrodeposition coating, a fluoro-resin vapor deposition coating, and baking after a solvent application of a silicone or a fluoro-resin coating and providing a water-repellent surface according to ink physical properties causes an ink droplet shape and a jetting out characteristics to be stabilized, so that a high quality image is obtained.

An ink feeding opening and an engraved frame 1 having a common liquid room 1-2 are made by an injection moulding of an epoxy system resin. A polyphenylene sulfide may be used as the resin material.

A displacement of the lamination direction occurs in the drive part 5-5 by applying a drive waveform (pulse voltage of 10-50V) to the drive part 5-5 according to a record signal. The liquid room 2-2 is pressurized through the vibration board 3, and an ink droplet is jetted out from the nozzle 3-1. After the end of the ink droplet discharge, the ink pressure in the liquid room 2-2 decreases, and a negative pressure occurs in the liquid room 2-2 by the electric discharge process of a drive pulse and an inertia of a flow of ink, and an ink feeding process starts. At this time, an ink from the ink tank flows into the common liquid room 1-2, and the ink passes along a fluid resistance part 2-1 through an ink inflow opening 6-3 from the common liquid room 1-2, and fills up in the liquid room 2-2. While the fluid resistance part 2-1 has an effect in attenuation of the residual pressure vibration after jetting out, it resists to a maximum filling (refill) by surface tension. By choosing the fluid resistance part suitably, an attenuation of the residual pressure and a refill time are maintained to have a balance, and time (drive cycle) until it shifts to a next ink droplet jetting out operation may be shortened.

Figure 9:
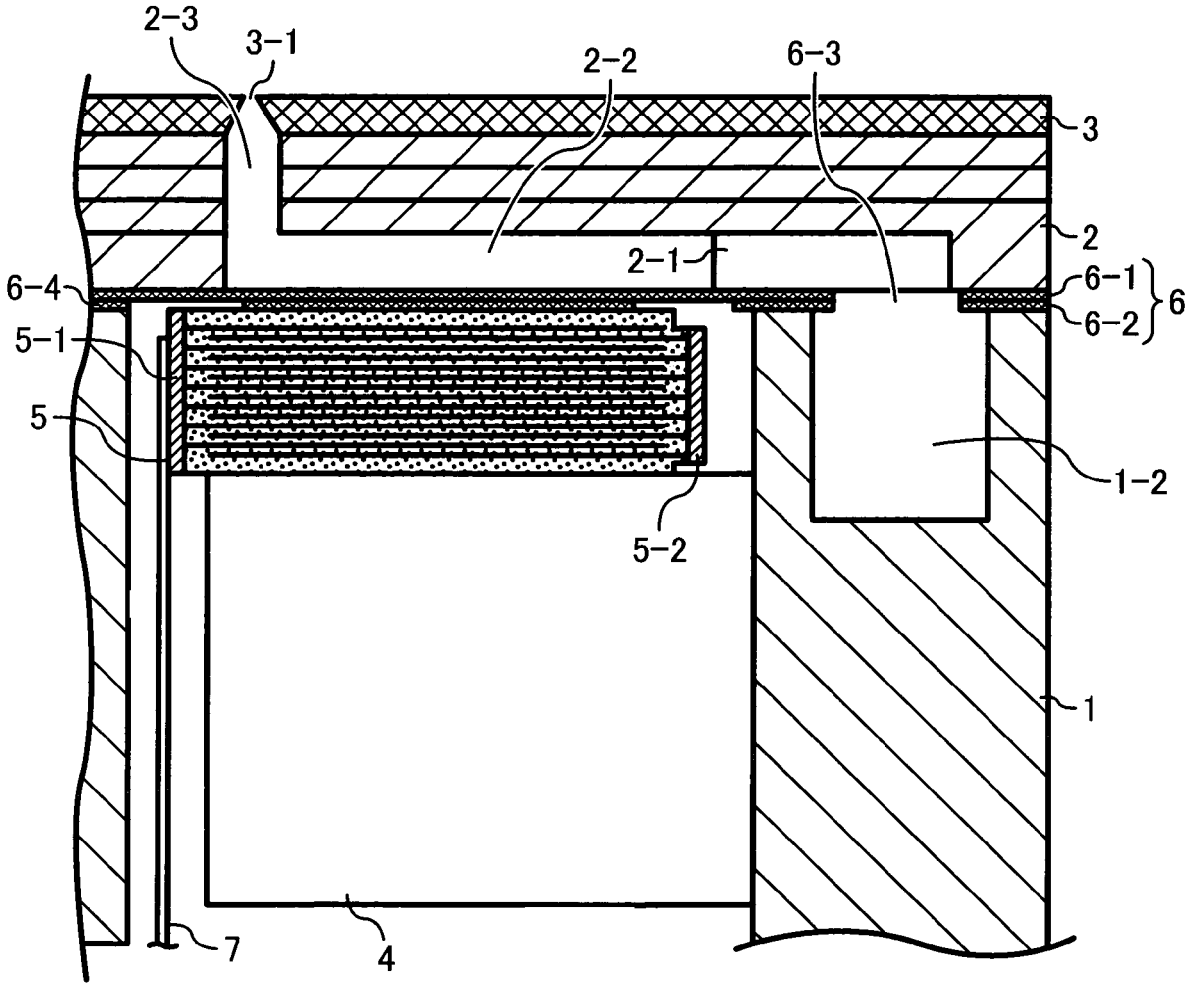
FIG. 9 is a cross-sectional diagram illustrating another exemplary configuration of a liquid room of a liquid drop jet apparatus according to an exemplary embodiment of the present disclosure.
Figure 10:
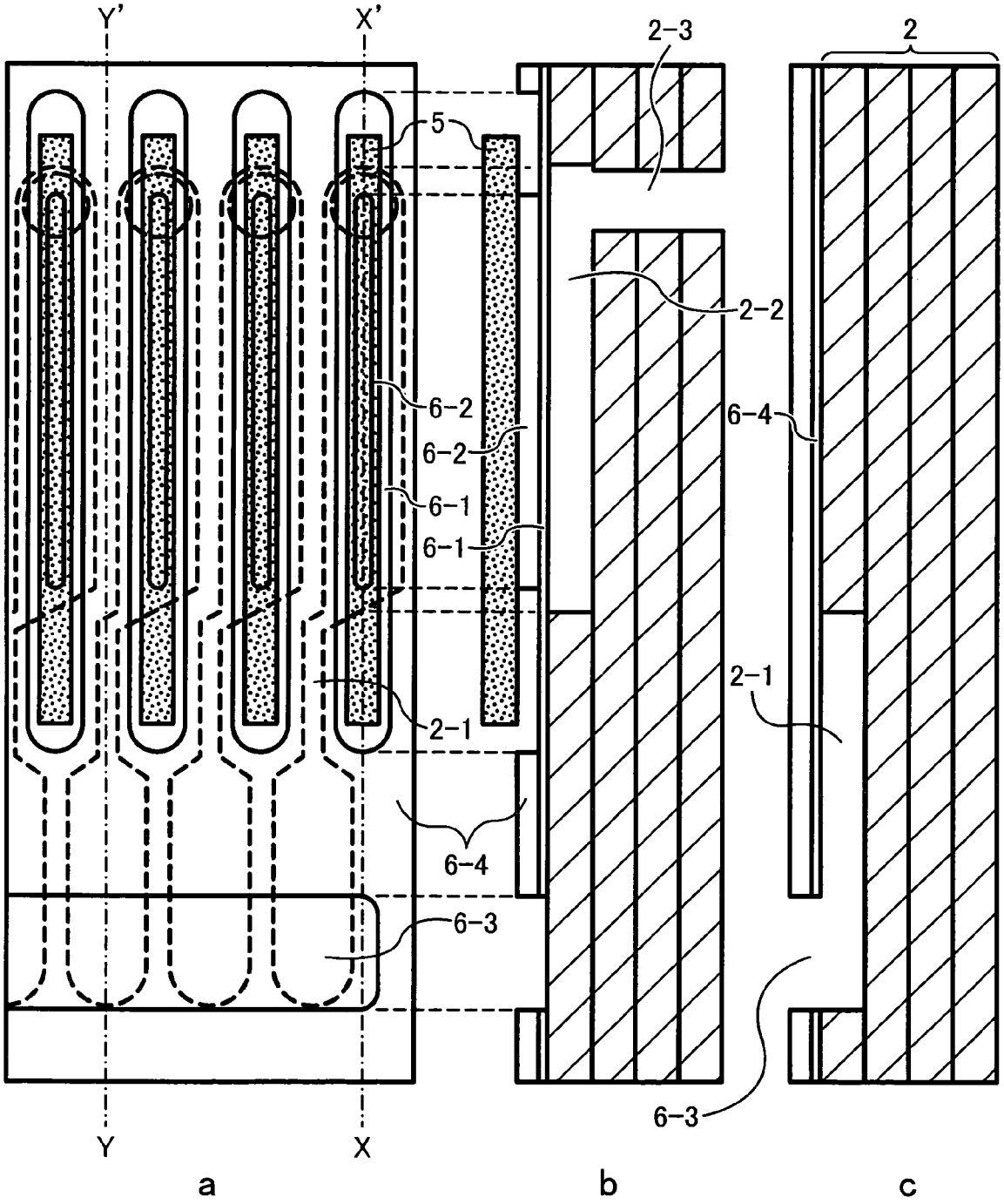
FIG. 10 is an illustration illustrating a layout of a vibration board configuration and a channel of the liquid drop jet apparatus of FIG. 9.

FIG. 9 is a cross-sectional diagram illustrating another exemplary configuration of a liquid room of a liquid drop jet apparatus according to an exemplary embodiment of the present disclosure. FIG. 10 is an illustration illustrating a layout of a vibration board configuration and a channel of the liquid drop jet apparatus of FIG. 9. FIG. 10(*a*) illustrates an upper side diagram of the layout of the vibration board configuration and the channel of the liquid drop jet apparatus. FIG. 10(*b*) is a cross-sectional diagram of a line part X-X' of the liquid drop jet apparatus of FIG. 10(*a*). FIG. 10(*c*) is a cross-sectional diagram of a line part Y-Y' of the liquid drop jet apparatus of FIG. 10(*a*). In FIG. 9 and FIG. 10, the same referential mark as FIG. 5 and FIG. 7 show the same constituent factor. This structure is the so-called normal pitch structure. Since the normal pitch structure has larger pitch of slot processing than that of the above-mentioned large pitch structure, the slot processing is easier than the first example. Since the support part 5-6 of the laminated piezoelectric element 5 is not used, it is preferable to support the whole channel unit with a frame 1. Therefore, the laminated piezoelectric element 5 has a short distance to the frame 1 having one sequence composition. Since it is preferable to support a channel deformation (raising up) due to a generated pressure required for a discharge in the liquid room 2-2 by a stiffness of the channel board 2, the channel board 2 has a structure having four glued SMS boards. A slot which constitutes the first liquid room 2-2 (near one to the vibration board 6) of the channel board 2 is provided by a penetration processing with an etching method of construction. A second SMS board through a 4th have a hole by press processing, which forms a connecting opening 2-3. Also in the case of such a head of normal pitch structure, when the laminated piezoelectric element 5 is larger than the liquid room 2-2, this exemplary embodiment is effective.

As shown in (a) of FIG. 10, an ink supply path is bent at a fluid resistance part 2-1, an area which passes through a thin diaphragm part 6-1 may be small. Although there is no support of the piezoelectric element in the thick frame part 6-4 in the example of this enforcement, a compliance is small enough by its pass through the frame part 6-4.

In the example, the ink jet head has a nozzle pitch of 150 dpi (169.3 micrometers). The liquid room 2-2 has a width of 139 micrometers. The channel partition 2-4 of the liquid room 2-2 has a thickness of 30.3 micrometers. The thin diaphragm part 6-1 has a thickness of 3 micrometers. The convex part 6-2 of the vibration board 6 and the frame part 6-4 have a thickness of 12 micrometers. In the example, a total thickness of the convex part and the frame part, but it is preferable that the total thickness of the vibration board 6 has more than 4.6 times thickness of a thin part thickness. The second example meets this conditions. Since the rigidity of a beam is proportional to the 3rd power of thickness, when the total thickness is 4.6 or more-time thickness, it is equivalent to becoming 4.6^3=97≈100 times, so that the rigidity may be double or more figures than the thin part. 15 (micrometer)^3/3 (micrometer)^3>100.

Therefore, even if there is no support part 5-6 of the laminated piezoelectric element 5 under the ink supply path, only the rigidity of the frame part 6-4 makes the compliance of the ink supply path to be small enough, the good jetting out characteristics is obtained.

When the frame part 6-4 of the vibration board 2 is too thin, it is hard to handle due to little stiffness of the vibration board 2. It is important that the vibration board has a total thickness of more than 10 micrometers for the sake of constructing method.

Figure 11:
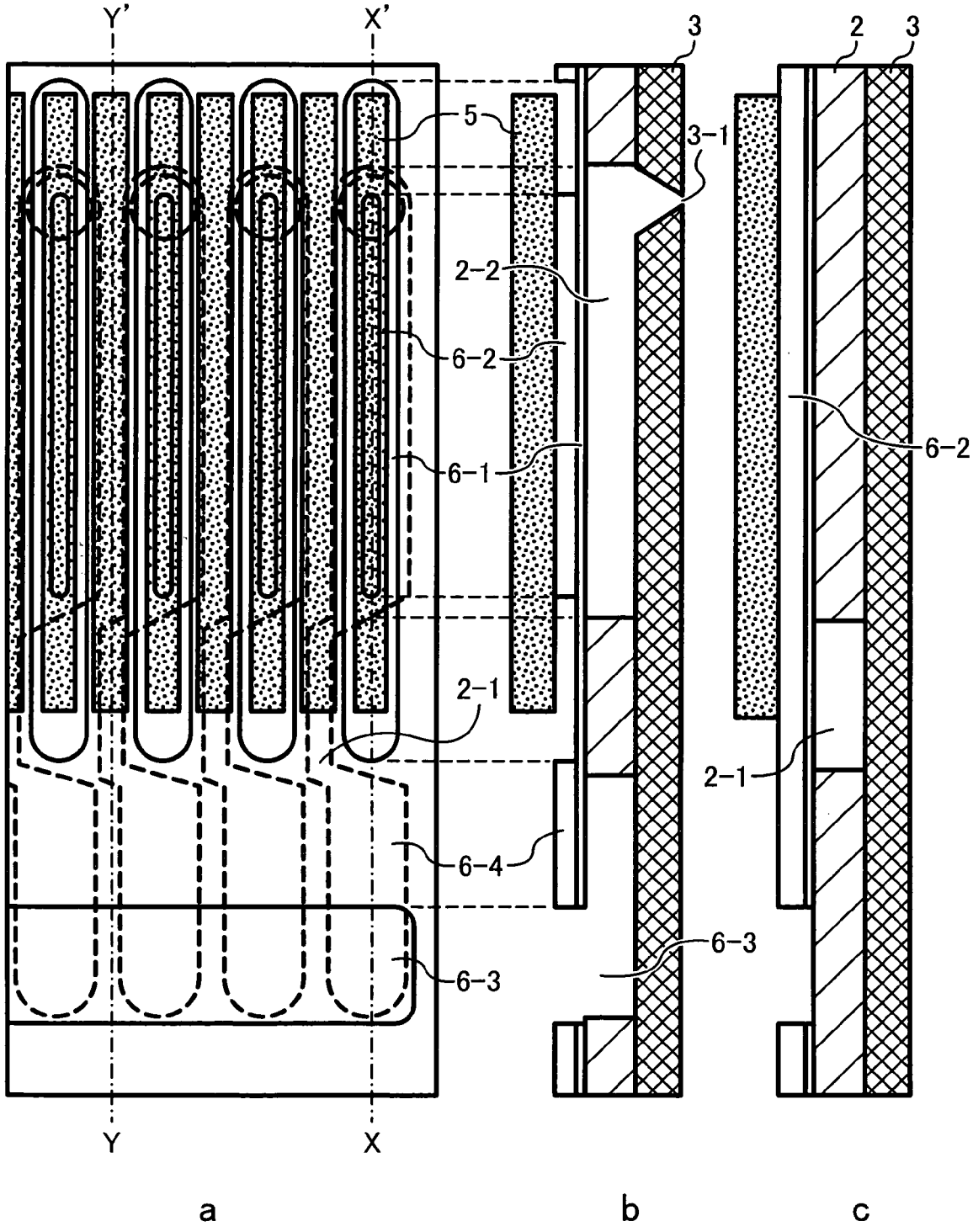
FIG. 11 is a cross-sectional diagram illustrating another exemplary configuration of a liquid room of a liquid drop jet apparatus according to an exemplary embodiment of the present disclosure.

FIG. 11 is a cross-sectional diagram illustrating another exemplary configuration of a liquid room of a liquid drop jet apparatus according to an exemplary embodiment of the present disclosure. FIG. 11(*a*) illustrates an upper side diagram of the layout of the vibration board configuration and the channel of the liquid drop jet apparatus. FIG. 11(*b*) is a cross-sectional diagram of a line part X-X' of the liquid drop jet apparatus of FIG. 11(*a*). FIG. 11(*c*) is a cross-sectional diagram of a line part Y-Y' of the liquid drop jet apparatus of FIG. 11(*a*). In FIG. 11, the same referential marks as FIG. 5 and FIG. 7 show the same constituent factor.

As shown in FIG. 11, a channel board 2, which is penetrated with a pattern, is covered with the nozzle board 3, and the liquid room 2-2 is constituted. An ink supply path is bent twice. The lamination piezoelectric element 5 has a large pitch structure. The ink supply path may pass through the frame part 6-4 of the vibration board 6. The ink supply path layout may be designed voluntarily with taking into consideration a fluid resistance determined from a demand of jetting out performance. If a side of a channel is the vibration board 6, the channel may adopt various composition.

A metal thin board laminated by a high polymer oriented film with adhesives is etched to form the vibration board 6 having the diaphragm part 6-1 of a high polymer rolling film, the convex part 6-2 of a metal layer, and the frame 6-4.

Figure 12:
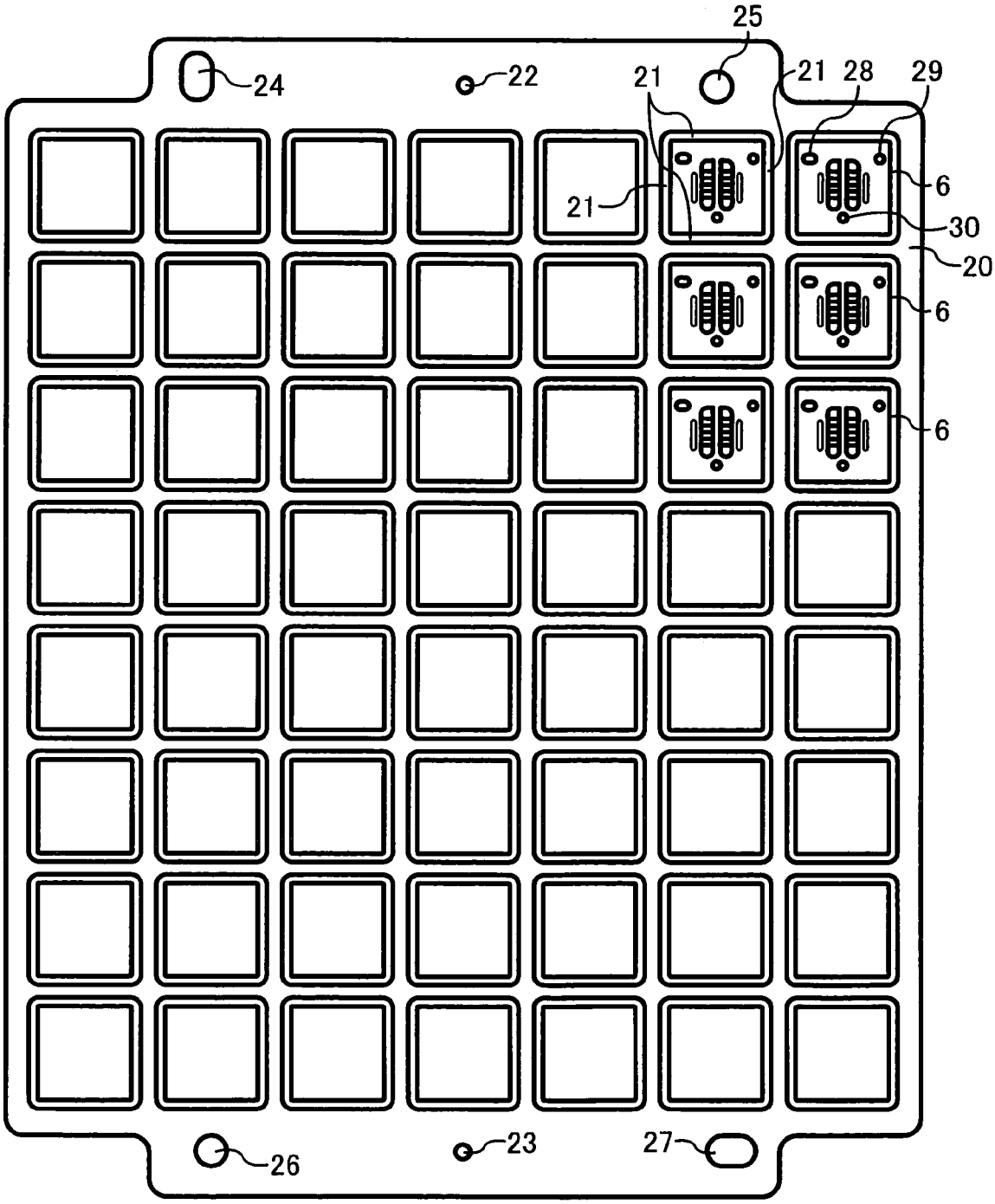
FIG. 12 illustrates a process of forming a vibration board of the liquid drop jet apparatus of FIG. 5.
Figure 13:
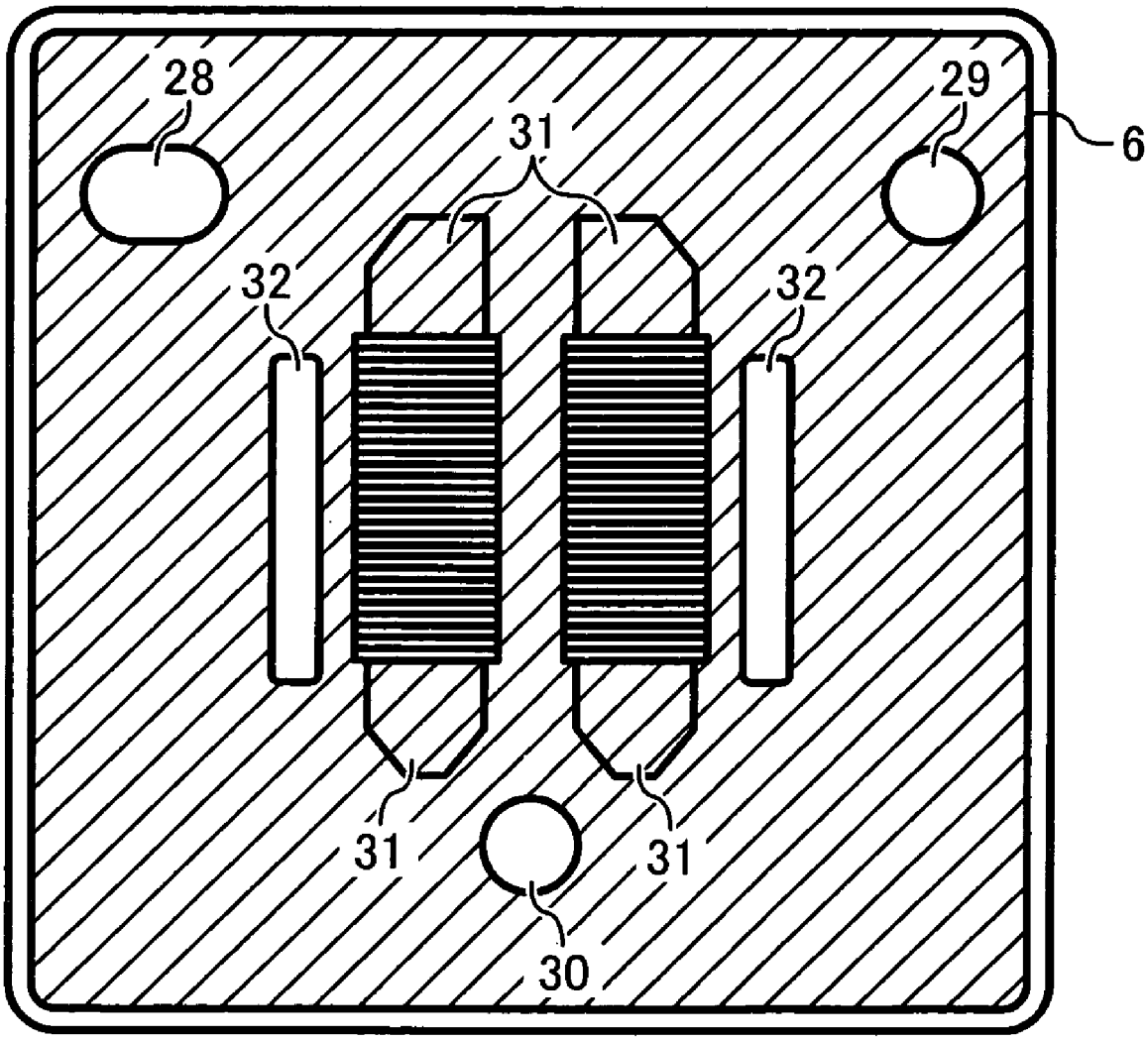
FIG. 13 is a magnified diagram of FIG. 12.

FIG. 12 illustrates a process of forming a vibration board of the liquid drop jet apparatus of FIG. 5. FIG. 13 is a magnified diagram of FIG. 12. As shown in FIG. 12, two or more vibration boards are collectively made from a laminate material of one sheet. As shown in FIG. 13, one vibration board is separated from the laminate material of FIG. 12. In an etching process described after, a metal thin board 20 around each vibration board 6 may be penetrated according to a formation of the convex part 6-2 as an island part. Then, a slot 21 of only a high polymer oriented film is formed, and each vibration board 6 is connected through the high polymer oriented film. After etching, the laminate material is removed from a glass substrate, the standard holes 24-27 for positioning for a large size are inserted with the positioning pin of a press, and each vibration board 6 is cut along the slot 21 to obtain each vibration board 6. Since the metal thin board of a cutting region is removed by etching and the high polymer oriented film is just cut, a life of a die of a press may be extended. In the vibration board 6 as shown in FIG. 13, since the thin metal board is removed by etching in a region 31 touched with a vibration unit and is surrounded with a concave region where adhesives expose and is electrically insulated with region where the vibration unit does not touch, a current leakage from a electrode of a dummy piezoelectric vibrator or from a top of the piezoelectric vibrator is prevented, and a breakage of the vibration board due to an electric corrosion is prevented. A window 32 is a window for absorbing vibration of the ink of ink collecting part which exists in the common liquid room, and is formed by etching only the metal thin board of a laminate material so that only a layer of a high polymer ductility film and adhesives is formed.

Figure 14A:
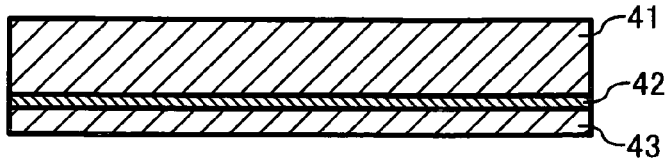
FIG. 14A is a cross-sectional diagram of a vibration board illustrating a process of manufacturing of the liquid drop jet apparatus of FIG. 5.
Figure 14B:
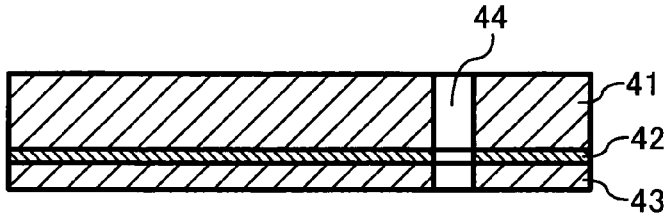
FIG. 14B is a cross-sectional diagram of a vibration board illustrating a process of manufacturing of the liquid drop jet apparatus of FIG. 5.
Figure 14C:
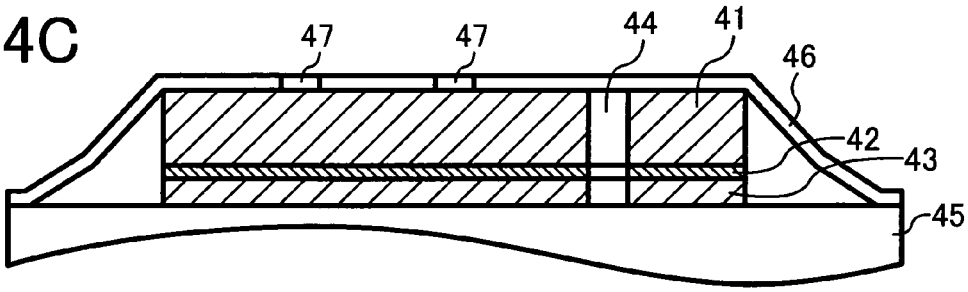
FIG. 14C is a cross-sectional diagram of a vibration board illustrating a process of manufacturing of the liquid drop jet apparatus of FIG. 5.
Figure 14D:
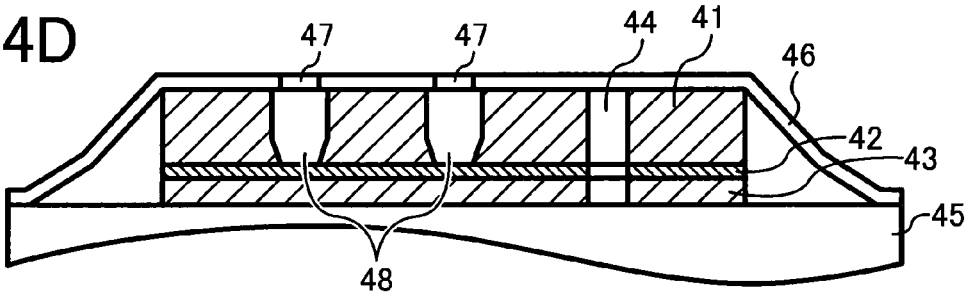
FIG. 14D is a cross-sectional diagram of a vibration board illustrating a process of manufacturing of the liquid drop jet apparatus of FIG. 5.

FIG. 14A is a cross-sectional diagram of a vibration board illustrating a process of manufacturing of the liquid drop jet apparatus of FIG. 5. FIG. 14B is a cross-sectional diagram of a vibration board illustrating a process of manufacturing of the liquid drop jet apparatus of FIG. 5. FIG. 14C is a cross-sectional diagram of a vibration board illustrating a process of manufacturing of the liquid drop jet apparatus of FIG. 5. FIG. 14D is a cross-sectional diagram of a vibration board illustrating a process of manufacturing of the liquid drop jet apparatus of FIG. 5. As shown in FIG. 14A, a thin metal board 41, which is durable to an ink, having a thickness of 30 micrometers such as a stainless steel is applied with an adhesive 42 on one side. After pre drying the adhesive, a high polymer oriented film 43 with a thickness of about 4 micrometers, for example, an oriented film of a polyphenylene sulfide (PPS) resin is pasted up and a laminate material is constituted. As shown in FIG. 14B, this laminate material is cut and a predetermined large-sized board is obtained. The standard holes 22 and 23 used at the time of etching pattern exposure of FIG. 12, the standard holes 24-27 for positioning in setting to a press, the standard holes 28 and 29 for positioning an independent vibration board 6 cut from the large-sized board, and the hole 30 used as an ink feed opening are provided beforehand by a press processing. As shown in FIG. 14C, the metal thin board 41 of the laminate material is provided on a glass substrate 45. A photosensitive polymer film 46 is provided on the surface of the metal thin board 41 so that an end may reach the surface of the glass substrate 45. The whole laminate material is fixed on the glass substrate 45 with the photosensitive polymer film 46. It is possible to perform the adhesion process of the photosensitive polymer film 46 and to fix it on the glass substrate 45 in one process by using such the process. Moreover, since the hole is formed beforehand in the laminate material by press processing, an end side of this hole is preferably protected from an etching solution. Therefore, a use of a resin film with high protection capability against an etching solution as compared with a liquid photoresist surely prevents a deformation of the hole at the etching process. The photosensitive polymer film 46 is exposed, positioning the mask in which the etching pattern is formed using the standard holes 22 and 23 of FIG. 14. A window 47 for etching is formed with a small relative error as compared with the standard holes 22 and 23 correctly provided by press processing. As shown in FIG. 14D, the metal thin board 41 is etched using this window 47. The metal thin board 41 is removed to form the convex part that is the island part surrounded by a region 48 that is a diaphragm part as the adhesives 42 is exposed.

Figure 15:
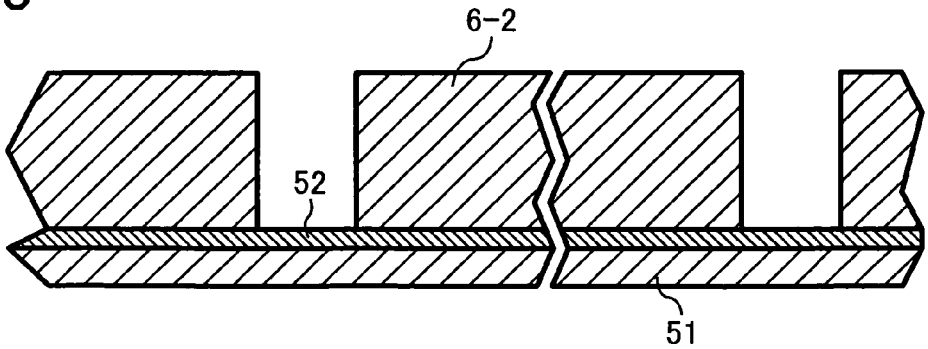
FIG. 15 is a cross-sectional diagram illustrating an exemplary configuration of a part of the vibration board of the liquid drop jet apparatus of FIG. 5.

FIG. 15 is a cross-sectional diagram illustrating an exemplary configuration of a part of the vibration board of the liquid drop jet apparatus of FIG. 5. In FIG. 15, the same referential marks as FIG. 5 and FIG. 7 show the same constituent factor. A convex part 6-2, which is an island part, and a thick surrounding part are fixed on a surface of a high polymer ductility film 51 through a layer of an adhesive 52, and a diaphragm part of the high polymer ductility film 51 where the adhesive 52 exposes is formed surrounding the thick surrounding part. Since the convex part 6-2, which is the island part, and the thick surrounding part are fixed on the surface of the high polymer ductility film 51 through the layer of the adhesive 52, a stress in the tip of the convex part 6-2 which is an island part is spread with the adhesive 52. The stress concentration to a high polymer oriented film is not only eased, but the surface adhesive 52 plays a role of a kind of seal material. Even if a crack or a defect exists in the high polymer ductility film 51, a leakage of ink may be prevented.

Generally, since a ductility film is fractured in a manufacturing process if it has defects, such as a pinhole, a product may not be made. For this reason, in a film which extended and made with an enough examined material, even if the thickness becomes very thin with about several micrometers, there are almost no defects such as a pinhole. Therefore, the ductility film is a high reliable material. Then, a high reliable product may be offered as compared with a conventional method which forms a layer of a high polymer film in a metal thin board by a solvent casting method, etc.

In the above-mentioned example, a stainless steel is used as a metal thin board. But, it is possible to etch the stainless steel. It is also possible to use other high adhesive metal such as a copper, a nickel, an iron, and silicone. As an high polymer oriented film, a polyphenylene sulfide (PPS) resin is used. But other high polymer oriented material may be used, such as a polyimide (PI) resin, a polyetherimide (PEI) resin, a polyamide-imide (PAI) resin, a polyparabanic acid (PPA) resin, a polysulfone (PSF) resin, a polyethersulfone (PES) resin, a polyetherketone (PEK) resin, a polyetheretherketone (PEEK) resin, a polyolefin (APO) resin, a polyethylenenaphthalate (PEN) resin, an aramid resin, a polypropylene resin, a vinylidene chloride resin, a polycarbonate resin, etc. It is possible to process a large region of the above-mentioned vibration board at once as mentioned above, so that lessening the number of division makes it possible to lengthen the vibration board easily. The convex part 6-2 and the thin metal film forming the thick part have a thickness of 30 micrometers. In order to make the compliance of the subject matter of this disclosure small or for a handling, it is desirable to have the thickness of at least 10 micrometers or more.

Figure 16:
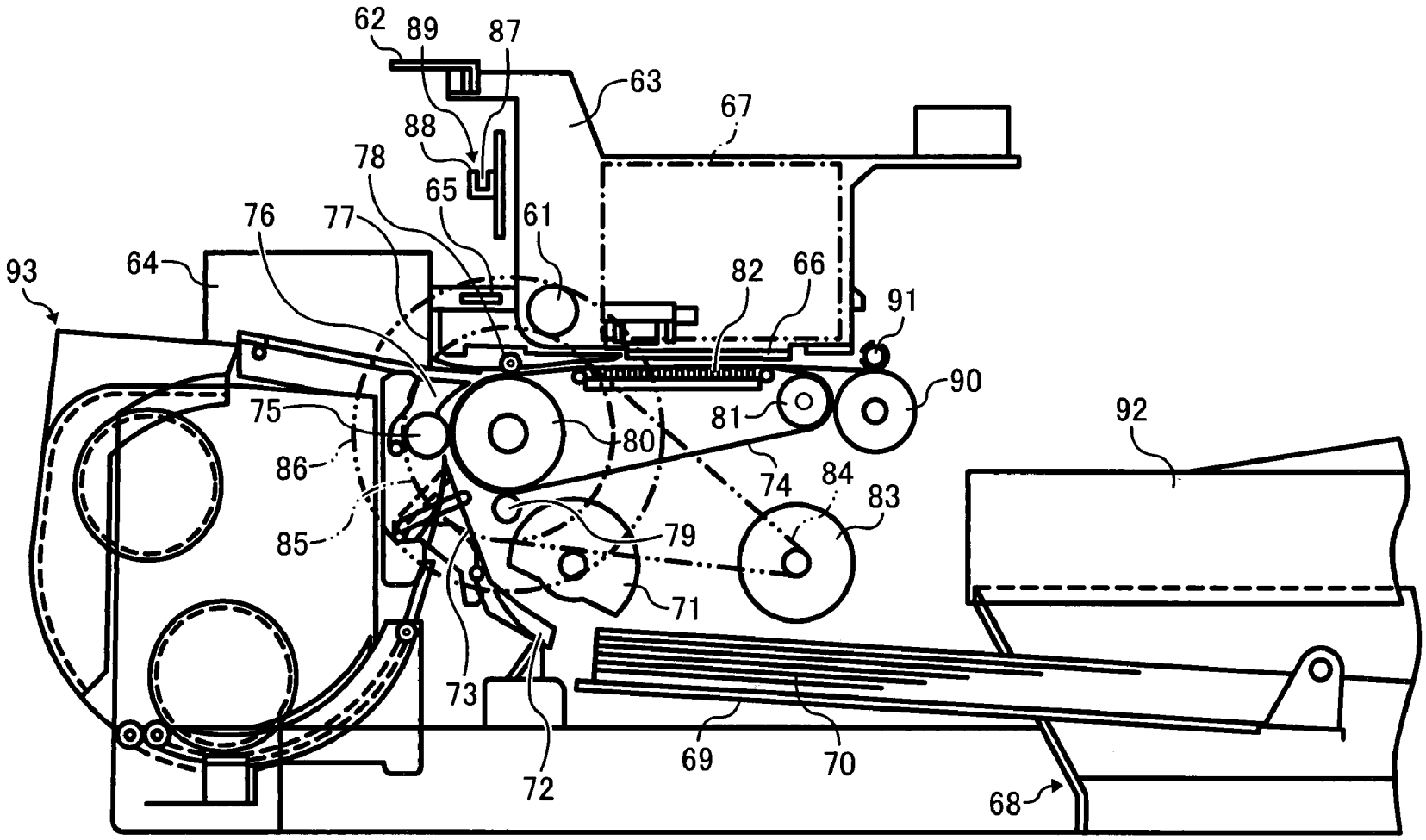
FIG. 16 is a cross-sectional diagram illustrating an exemplary configuration of an image forming apparatus according to an exemplary embodiment of the present disclosure.
Figure 17:
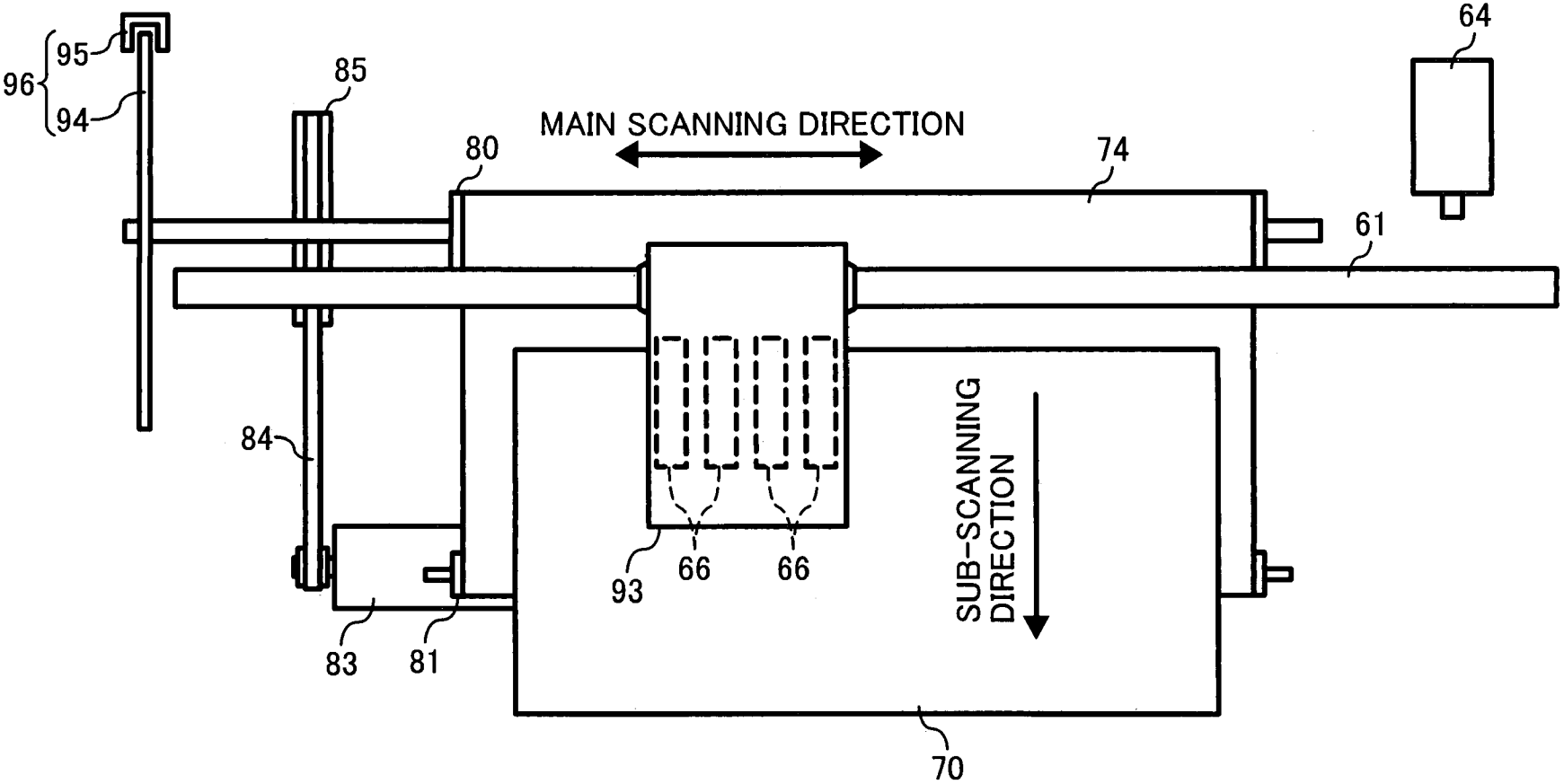
FIG. 17 is a plane diagram illustrating a principal part of the image forming apparatus of FIG. 16.

A serial type ink-jet recording apparatus which carries an ink jet head in accordance with an exemplary embodiment of this disclosure is explained. But, it is not necessary to limit to this serial type of recording apparatus. Since it is not dependent on a conveyance means of a recording medium, the ink jet recording head of this disclosure may be applied to a full line type recording apparatus. FIG. 16 is a cross-sectional diagram illustrating an exemplary configuration of an image forming apparatus according to an exemplary embodiment of the present disclosure. FIG. 17 is a plane diagram illustrating a principal part of the image forming apparatus of FIG. 16.

The image forming apparatus, which is an ink jet recording apparatus, includes a guide rod 61 across side boards (not shown), a guide rail 62, a carriage 63, a main scanning motor 64, and a timing belt 65. The carriage 63 may be moved by the main scanning motor 64 through the timing belt 65 in the main scanning direction as shown in FIG. 17. On this carriage 63, a recording head 66 that includes four liquid drop jet heads jetting out an ink droplet of each color of a yellow (Y), a cyan (C), a magenta (M), and a black (Bk) is arranged so that a sequence of two or more ink discharge mouths intersects the main scanning direction and the ink jetting direction is downward. The recording head 66 as a liquid drop jet head includes a piezoelectric actuators such as a piezoelectric element. A sub tank 67 of each color for supplying the ink is carried in the recording head 66 at the carriage 63. The ink is supplied to the sub tank 67 from a main tank (ink cartridge) through an ink supply tube which is not illustrated. In one example, the sub tank 67 and the recording head 66 can constitute the liquid drop jet apparatus. The sub tank 67 may be separately provided outside the liquid drop jet head, or no use of the sub tank may be possible.

A feed sheet part includes, a sheet paper cassette 68, a paper stacking part (a pressure plate) 69, a paper sheet 70, a feed roller 71, and a separation pad 72 that presses the feed roller 71 and has a large friction coefficient. The feed roller 71 and the separation pad 72 feed the paper sheet 70 one by one from the paper cassette 68. A conveyance part under the recording head 66 includes a guide 73, a conveyance belt 74, a counter roller 75, a conveyance guide 76, a pushing member 77, and a tip pressing roller 78. The conveyance belt 74 adsorbs the paper sheet 70 electrostatically. The conveyance belt 74 and the counter roller 75 tightly hold the paper sheet 70 guided by the guide 73. The conveyance guide 76 changes a conveying direction of the paper sheet 70 from about vertical direction to a horizontal direction for a moving direction of the conveyance belt 74. The tip pressing roller 78 is pressed to a side of the conveyance belt 74 with the pushing member 77. A charge roller 79 for charging the surface of the conveyance belt 74 is provided.

The conveyance belt 74 is an endless belt. The conveyance belt 74 is tensed between a conveyance roller 80 and a tension roller 81 and is rotated with a rotation of the conveyance roller 80 driven by a sub-scanning motor 83 through a timing belt 84 and a timing roller 85 in a sub-scanning direction as shown in FIG. 17. A guide member 82 is provided at the back side of the conveyance belt 74 according to an image forming region with the recording head 66.

A slit disk 94 is attached to a shaft of the conveyance roller 80. A sensor 95 is provided to detect the slit disk 94. The slit disk 94 and the sensor 95 constitute an encoder 96. The charge roller 79 is arranged so that it may contact the surface of the conveyance belt 74, and it may be rotated with a rotation of the conveyance belt 74. The charge roller 79 is pressed by a force of 2.5 N at each end of the shaft. As shown in FIG. 16, an encoder scale 87 in which a slit is formed is provided at front side of the carriage 63. An encoder sensor 88 having a penetrated type photograph sensor which detects the slit of the encoder scale 87 is provided at front side of the carriage 63. The encoder scale 87 and the encoder sensor 88 constitute an encoder 89 for detecting a main scanning direction position (a position to a home position).

A paper ejection part includes a separation part where the paper sheet 70 is separated from the conveyance belt 74, an ejection roller 90, an ejection roller 91, and a catch tray 92 that is for stacking ejected paper sheets. A detachable double-sided feeding unit 93 is provided on the back. This double-sided feeding unit 93 takes in the paper 70 returned by an opposite direction rotation of the conveyance belt 74, reversing the paper 70, and feeding in the paper 70 again between the counter roller 75 and the conveyance belt 74.

Like this, the paper sheet 70 is separated and conveyed one by one from the paper sheet feeding part. The paper sheet 70 is guided with the guide 73 and is conveyed by the conveyance belt 74 and the counter roller 75. Further, the paper sheet 70 is guided with the conveyance guide 76 and is pressed to the conveyance belt 74 with the tip pressing roller 78, so that a conveyance direction is changed by about 90 degrees.

At this time, the charge roller 79 is applied alternating voltage from a high-voltage power supply with a control circuit (not shown). The conveyance belt is charged by a plus and minus stripe pattern in sub-scanning direction alternately. When the paper sheet 70 is conveyed on the alternately charged conveyance belt 74, the paper sheet 70 is absorbed electrostatically on the conveyance belt 74, and the paper sheet 70 is conveyed to a sub-scanning direction with a rotation of the conveyance belt 74.

Moving the carriage 63 and driving the recording head 66 according to an image signal, one line is recorded on the held paper sheet 70 with jetting out an ink droplet. And the paper sheet 70 is conveyed predetermined distance, a next line is recorded. When receiving a record end signal or a signal which shows that a back end of the paper 70 reaches a record region, a record operation ends. The paper sheet 70 is ejected onto the catch tray 92. When a double-sided feeding is performed, the double-sided feeding unit 93 takes in the paper 70 returned by an opposite direction rotation of the conveyance belt 74 after ending of a one side record, reversing the paper 70, and feeding in the paper 70 again between the counter roller 75 and the conveyance belt 74. Controlling timing, after recording on the back of the paper 70 conveyed by the conveyance belt 74 like the above mentioned way, the paper sheet 70 is ejected onto the catch tray 92.

The image forming apparatus of this disclosure is applicable to a printer, a facsimile machine, a copy machine, a multi function image forming machine, etc. This disclosure is also applicable to a liquid drop jet head, a liquid drop jet apparatus or an image forming apparatus including the liquid drop jet head or the liquid drop jet apparatus, which jets out a liquid other than an ink, for example, a DNA sample, a resist pattern material, etc.

This disclosure is not limited to the above-mentioned examples and exemplary embodiments. Numerous additional modifications and variations are possible in light of the above teachings. It is therefore to be understood that within the scope of the appended claims, the disclosure of this patent specification may be practiced otherwise than as specifically described herein. For example, elements and/or features of different examples and illustrative embodiments may be combined with each other and/or substituted for each other within the scope of this disclosure and appended claims.

This patent specification is based on Japanese patent applications, No. JPAP2005-340329 filed on Nov. 25, 2005 in the Japan Patent Office, the entire contents of which are incorporated by reference herein.

What is claimed:

1. A liquid drop jet apparatus to form an image, comprising:

a plurality of nozzles to jet out a liquid droplet;

a plurality of liquid rooms corresponding to the plurality of nozzles;

a liquid supply path to supply a liquid into the plurality of liquid rooms;

a plurality of vibration boards to apply pressure to the liquid in the plurality of corresponding liquid rooms, wherein each vibration board has a thin region corresponding to a wall of the corresponding liquid room and a thicker region thicker than the thin region, a longitudinal length of the thin region is longer than a longitudinal length of the liquid room, and the thicker region includes an end corresponding to a side of the liquid supply path; and a plurality of electromechanical converters to vibrate the plurality of vibration boards.

2. The liquid drop jet apparatus of claim 1, wherein the liquid supply path includes a straight line portion included in the thicker region, and includes a bending portion to be connected through the liquid room.

3. The liquid drop jet apparatus of claim 2, further comprising:

a channel board corresponding to one of the other walls of the liquid room, wherein each vibration board includes a convex portion corresponding to the thicker region of the vibration board, and a thick frame portion surrounding the convex portion, and the electromechanical converter corresponding to the liquid room connects the vibration board only at the convex portion, and the liquid supply path bends so that the liquid supply path can pass through the thick frame portion.

4. The liquid drop jet apparatus of claim 3, wherein the convex portion connects with an active region of the piezoelectric element displaced in a d33 direction.

5. The liquid drop jet apparatus of claim 4, wherein a length of the active region of the piezoelectric element displaced in a d33 direction is longer than the convex portion in a longitudinal direction of the liquid room by two times of an inactive region or more, the convex region is connected at substantially a center of the active region.

6. The liquid drop jet apparatus of claim 1, wherein a piezoelectric element displaced in a d33 direction is used as the electromechanical converter.

7. The liquid drop jet apparatus of claim 1, wherein the vibration board includes a resin layer, an adhesive layer, and a metal layer that includes the thicker region.

8. The liquid drop jet apparatus of claim 7, wherein an oriented film is used as the resin layer.

9. The liquid drop jet apparatus of claim 7, wherein the metal layer has a thickness of 10 micrometers or more.

10. The liquid drop jet apparatus of claim 1, wherein the vibration board includes two or more layers formed by an electroforming.

11. The liquid drop jet apparatus of claim 1, wherein the thicker region of the vibration board has a thickness of 4.6 or more times of the thickness of the thin region.

12. The liquid drop jet apparatus of claim 1, wherein the electromechanical converter is separated by twice of the nozzles pitch.

13. The liquid drop jet apparatus of claim 1, wherein an electric connection to the electromechanical converter is connected from the liquid supply path.

14. An image forming apparatus, comprising:

a liquid drop jet apparatus to form an image includes a plurality of nozzles to jet out a liquid droplet, a plurality of liquid rooms corresponding to the plurality of nozzles, a liquid supply path to supply a liquid into the plurality of liquid rooms, a plurality of vibration boards to apply pressure to the liquid in the plurality of corresponding liquid rooms, wherein each vibration board has a thin region corresponding to a wall of the corresponding liquid room and a thicker region thicker than the thin region, a longitudinal length of the thin region is longer than a longitudinal length of the liquid room, and the thicker region includes an end corresponding to a side of the liquid supply path, and a plurality of electromechanical converters to vibrate the plurality of vibration boards.

15. A liquid drop jet apparatus to form an image, comprising:

a nozzle to jet out a liquid droplet;

a liquid room to provide a liquid to the nozzle;

a liquid supply path to supply the liquid into the liquid room;

a vibration board to apply pressure to the liquid in the liquid room, wherein the vibration board has a thin diaphragm part corresponding to a wall of the liquid room and a thicker part thicker than the thin diaphragm part, a longitudinal length of the thin diaphragm part is longer than a longitudinal length of the liquid room, and the thicker part includes an end corresponding to a side of the liquid supply path; and an electromechanical converter to vibrate the vibration board, wherein the liquid supply path includes a bending portion connected to the liquid room.

* * * * *